US009422099B2

(12) United States Patent
Mitchell et al.

(10) Patent No.: US 9,422,099 B2
(45) **Date of Patent: *Aug. 23, 2016**

(54) INSULATED CONTAINER WITH WORK SURFACE

(71) Applicants: Elizabeth Mitchell, Toronto (CA); Mike Baatz, Laval (CA); William Kearns, Brampton (CA); Christopher Edwards, Nepean (CA); Melvin Mogil, North York (CA); Richard Stephens, Chicago, IL (US)

(72) Inventors: Elizabeth Mitchell, Toronto (CA); Mike Baatz, Laval (CA); William Kearns, Brampton (CA); Christopher Edwards, Nepean (CA); Melvin Mogil, North York (CA); Richard Stephens, Chicago, IL (US)

(73) Assignee: CALIFORNIA INNOVATIONS INC. (CA)

( * ) Notice: Subject to any disclaimer, the term of this patent is extended or adjusted under 35 U.S.C. 154(b) by 40 days.

This patent is subject to a terminal disclaimer.

(21) Appl. No.: 14/312,108

(22) Filed: Jun. 23, 2014

(65) Prior Publication Data

US 2015/0360846 A1 Dec. 17, 2015

Related U.S. Application Data

(63) Continuation of application No. 13/532,182, filed on Jun. 25, 2012, now Pat. No. 8,777,045.

(51) Int. Cl.

| | |
|---|---|
| ***B65D 81/38*** | (2006.01) |
| ***A45C 11/20*** | (2006.01) |
| ***A45F 3/02*** | (2006.01) |

(Continued)

(52) U.S. Cl.

CPC ..... *B65D 81/3888* (2013.01); *A45C 7/0077* (2013.01); *A45C 11/20* (2013.01); *A45F 3/02* (2013.01); *B65D 81/38* (2013.01); *A45C 9/00* (2013.01); *B65D 25/14* (2013.01); *B65D 25/28* (2013.01); *B65D 45/00* (2013.01)

(58) Field of Classification Search

CPC ..... B65D 25/14; B65D 25/28; B65D 45/00; B65D 81/38; B65D 1/04; B65D 63/08

USPC ..... 220/315, 666, 720, 752, 592.2, 592.02, 220/592.03, 254.3, 6; 383/110, 2, 119; 53/440, 467

See application file for complete search history.

(56) References Cited

U.S. PATENT DOCUMENTS

| | | | |
|---|---|---|---|
| 294,622 | A | 3/1884 | Honinger |
| 3,791,547 | A | 2/1974 | Branscum |

(Continued)

FOREIGN PATENT DOCUMENTS

| | | |
|---|---|---|
| CA | 2149491 | 11/1996 |

*Primary Examiner* — Fenn Mathew
*Assistant Examiner* — Elizabeth Volz
(74) *Attorney, Agent, or Firm* — Ostrolenk Faber LLP

(57) ABSTRACT

A soft sided insulated container assembly includes a first portion having an insulated, soft sided external wall structure, and a second portion that defined a lid co-operable with the first portion. The lid includes an auxiliary access opening and closure member that are smaller than the main opening, and that can be operated one-handed. A rigid work surface is provided, typically immediately adjacent to the secondary closure member, the work surface providing a place for holding or mixing a drink or for preparing a snack. In some embodiments the work surface may be movable relative to the container, whether slidable in a co-planar or parallel planar manner in translation, or folding as in a foldable shelf. The entire container assembly may be foldable or collapsible to a storage condition, and the rigid member, whether fixed or movable, does not impede that folding or collapsing.

22 Claims, 35 Drawing Sheets

(51) Int. Cl.

| | |
|---|---|
| ***A45C 7/00*** | (2006.01) |
| *A45C 9/00* | (2006.01) |
| *B65D 25/14* | (2006.01) |
| *B65D 25/28* | (2006.01) |
| *B65D 45/00* | (2006.01) |

(56) References Cited

U.S. PATENT DOCUMENTS

| | | | | |
|---|---|---|---|---|
| 4,286,440 | A | 9/1981 | Taylor | |
| 4,323,180 | A | 4/1982 | Sloop | |
| 4,499,998 | A | 2/1985 | Carlson | |
| 4,537,313 | A | 8/1985 | Workman | |
| 4,673,117 | A | 6/1987 | Calton | |
| 4,819,793 | A | 4/1989 | Willard | |
| 4,889,257 | A | 12/1989 | Steffes | |
| D328,550 | S | 8/1992 | Mogil | |
| 5,156,291 | A | 10/1992 | Mielke | |
| D340,387 | S | 10/1993 | Melk | |
| D340,621 | S | 10/1993 | Melk | |
| D340,840 | S | 11/1993 | Melk | |
| 5,337,911 | A | 8/1994 | Holub | |
| D355,568 | S | 2/1995 | Paulin | |
| 5,403,095 | A | 4/1995 | Melk | |
| 5,501,338 | A | 3/1996 | Preston | |
| D368,387 | S | 4/1996 | Bureau | |
| 5,505,307 | A | 4/1996 | Shink | |
| D371,052 | S | 6/1996 | Melk | |
| 5,537,911 | A | 7/1996 | Ohlrogge | |
| D373,514 | S | 9/1996 | Melk | |
| D373,515 | S | 9/1996 | Melk | |
| 5,649,658 | A | 7/1997 | Hoffman | |
| D382,771 | S | 8/1997 | Mogil | |
| D382,772 | S | 8/1997 | Mogil | |
| D387,249 | S | 12/1997 | Mogil | |
| D391,121 | S | 2/1998 | Melk | |
| D394,552 | S | 5/1998 | Melk | |
| 5,857,778 | A | 1/1999 | Ells | |
| D408,225 | S | 4/1999 | Hodosh | |
| 5,904,230 | A | 5/1999 | Peterson | |
| 5,924,303 | A | 7/1999 | Hodosh | |
| 5,938,646 | A | 8/1999 | Carter | |
| D419,770 | S | 2/2000 | Mogil | |
| D421,366 | S | 3/2000 | Mogil | |
| 6,047,976 | A | 4/2000 | Wang | |
| 6,067,816 | A | 5/2000 | Hodosh | |
| 6,068,402 | A | 5/2000 | Freese | |
| 6,092,661 | A | 7/2000 | Mogil | |
| 6,105,844 | A | 8/2000 | Walters | |
| 6,116,045 | A | 9/2000 | Hodosh | |
| D435,342 | S | 12/2000 | Mogil | |
| D435,968 | S | 1/2001 | Mogil | |
| D436,442 | S | 1/2001 | Mogil | |
| 6,234,677 | B1 | 5/2001 | Mogil | |
| 6,237,776 | B1 | 5/2001 | Mogil | |
| 6,238,091 | B1 | 5/2001 | Mogil | |
| 6,247,328 | B1 | 6/2001 | Mogil | |
| D445,307 | S | 7/2001 | Fickle | |
| D446,937 | S | 8/2001 | Mogil | |
| 6,296,165 | B1 | 10/2001 | Mears | |
| D452,075 | S | 12/2001 | Mogil | |
| 6,336,342 | B1 | 1/2002 | Zeddies | |
| D453,625 | S | 2/2002 | Mogil | |
| 6,363,739 | B1 | 4/2002 | Hodosh | |
| 6,439,389 | B1 | 8/2002 | Mogil | |
| 6,481,239 | B2 | 11/2002 | Hodosh | |
| 6,513,661 | B1 | 2/2003 | Mogil | |
| 6,582,124 | B2 | 6/2003 | Mogil | |
| 6,644,063 | B2 | 11/2003 | Mogil | |
| 6,821,019 | B2 | 11/2004 | Mogil | |
| 7,162,890 | B2 | 1/2007 | Mogil | |
| 7,669,436 | B2 | 3/2010 | Mogil | |
| 8,777,045 | B2 * | 7/2014 | Mitchell | A45C 11/20 220/254.3 |
| 2001/0010312 | A1 | 8/2001 | Mogil | |
| 2001/0039807 | A1 | 11/2001 | Mogil | |
| 2002/0043076 | A1 | 4/2002 | Hodosh | |
| 2002/0126920 | A1 | 9/2002 | Mogil | |
| 2003/0024960 | A1 | 2/2003 | Greenstein | |
| 2003/0198408 | A1 | 10/2003 | Mogil | |
| 2004/0035143 | A1 | 2/2004 | Mogil | |
| 2004/0074936 | A1 | 4/2004 | McDonald | |
| 2004/0136621 | A1 | 7/2004 | Mogil | |
| 2005/0103044 | A1 | 5/2005 | Mogil et al. | |
| 2005/0117817 | A1 | 6/2005 | Mogil | |
| 2005/0205459 | A1 | 9/2005 | Mogil | |
| 2007/0237432 | A1 | 10/2007 | Mogil | |
| 2009/0095757 | A1 | 4/2009 | Ramundi | |
| 2009/0272279 | A1 | 11/2009 | Kleck | |
| 2009/0294455 | A1 | 12/2009 | Pruchnicki | |
| 2010/0089929 | A1 | 4/2010 | Ramundi | |
| 2010/0116830 | A1 | 5/2010 | Mogil | |
| 2010/0282763 | A1 | 11/2010 | Mogil | |
| 2011/0127274 | A1 | 6/2011 | Mogil | |

* cited by examiner 112
118
132
$P_{112}$
$P_{132}$
134
118
112
118
126
122
$P_{112}$
$P_{124}$
'4B'
130
120
124
128
118
115
100
112
128
'4C'
130
113
122
'4D'
116
134
'4B'
104
130
102
110
114
'4C'
132
'4D'

118
130
$P_{124}$
$P_{112}$
102
130
128
110
126
122
132
104
134
$P_{112}$
108
100

INSULATED CONTAINER WITH WORK SURFACE

The present application is a continuation under 37 C.F.R. §1.53(b) of, and claims priority to, prior U.S. patent application Ser. No. 13/532,182, filed Jun. 25, 2012 by Elizabeth MITCHELL, Mike BAATZ, William KEARNS, Christopher EDWARDS, Melvin MOGIL and Richard STEPHENS entitled INSULATED CONTAINER WITH WORK SURFACE, the entire content of the applications is incorporated by reference.

FIELD OF THE INVENTION

This invention relates to the field of portable insulated containers.

BACKGROUND OF THE INVENTION

Portable, soft-sided insulated containers may be used to transport articles that may best be served cool, such as beverages or salads, or warm, such as appetizers, hot dogs, and so on. Such containers are also used to carry liquids, whether hot liquids, such as soup containers, coffee or tea, or cold liquids such as beer, soft drinks, or other carbonated beverages, juices and milk. The containers are typically made in a generally cube-like shape, whether of sides are of equal length or not, having a base, four upstanding walls, and a top. The top wall is often a lid which opens to permit articles to be placed in, or retrieved from, the container. In soft-sided coolers, the main closure of the lid has tended to depend on the closing of a zipper, often a zipper running around three sides of a rectangle, with the fourth side being hinged.

It may be that some people would prefer not to have the sometimes cumbersome bother of opening the main closure, particularly if it requires the use of two hands, and if the process is awkward. They may prefer the use of a closure member that can be used with one hand, such as a zipperless closure member. Further, while opening the main closure member to fill the insulated container may be appropriate, and may occur in the kitchen or at another loading location where full access is desired and convenient, it may also be that when the unit is being used, opening the full main closure member may lead to more rapid heat loss (or gain, as may be) than if a smaller, auxiliary, closure member were used.

Furthermore, when an object is removed from the cooler, it may be that it would be convenient to have some place to rest that object temporarily. It may be that one wishes to put down a drink in a glass while reaching for a can of ginger ale or cola to freshen a drink, or to have a place where a lemon or lime can be sliced suitably. For whatever reason, it may be desirable to have a place for resting objects, even if merely to free one's hand to close the cooler. It may also be convenient for that resting place to be adjacent to the easily accessed opening; for that resting place to be firm, such that objects placed upon it may be less prone to wobble or tip, and for that resting place to be washable such that it may be wiped clean with a cloth should drinks or other objects be spilled on it. Further still, it may be convenient for that resting place to be such as may discourage, or limit, the extent to which objects may slide if the surface is not precisely level, as may be the case at a pic-nic, at a sporting venue, or at the beach.

In the event that the insulated container is a collapsible insulated container that may be collapsed or folded to a collapsed position when not in use, it may be that a rigid working surface, or table top, however it may be called, may be mounted in such a way as not to obstruct movement of the assembly to the folded or collapsed, or storage condition. Alternatively, the rigidity of the work surface may define a frame, or stiffening member, that, when in place, may tend to encourage the assembly to maintain its shape when in use.

SUMMARY OF THE INVENTION

In an aspect of the invention there is a soft-sided insulated container, or container assembly, having a rigid member defining a table top. In an additional feature of that aspect of the invention the rigid member may be an upper member of the container or container assembly. In a further feature is may include an element adapted to discourage objects from sliding thereoff.

In a further feature of that aspect of the invention, the closure member is movable to govern internal access to the container. In another feature the closure member is a zipperless closure member. In still another feature, the soft-sided insulated container is movable between folded position and an expanded position and has securements operable releasably to secure the container in the folded position.

In another aspect of the invention there is a soft-sided insulated container having a body and a top. The body has a soft-sided insulated wall structure defining a cavity therewithin in which to receive objects. At least a portion of the top defines a first closure member of the insulated container, the first closure member being movable between a closed position and an open position to govern access to the cavity. The top includes a rigid member; and, when the first closure member is in the closed position, the rigid member defines an externally accessible work surface upon which to place objects.

In another feature of that aspect of the invention the rigid member overlies an insulated layer portion of the top. In still another feature, the top panel has a breadth and a width, and the rigid member has at least one of (a) a breadth less than the breadth of the top panel; and (b) a width that is less than the width of the top. In yet another feature, the rigid member spans the top panel in one direction. In a further feature, the top has a front edge and an opposed rear edge, a left hand edge and an opposed right hand edge, and the rigid panel spans the top cross-wise between the left hand and right hand edges. In still yet another feature, the rigid member has a margin running along the front edge of the top. In an additional feature, the rear edge of the top is hingedly connected to the body of the container, and the rigid member has rear margin spaced from the rear edge of the top. In yet another additional feature, a rearward portion of the top is defined between the rear edge of the top and the rear margin of the rigid member, and the rearward portion of the top is pliable, permitting the rearward portion to bend on a curve. In still another feature, the top has one of: (a) an inset secondary closure member adjacent to the rigid member; and (b) an inset secondary closure member formed amidst the rigid member. In a further feature, the secondary closure member is a zipperless closure member, the secondary closure member is pivots on a hinged connection, and the secondary closure member is oriented to open toward a largest portion of the work surface.

In another feature, the top is hingedly mounted to the body of the container. In an additional feature, the body has an upper margin defining a periphery of an opening of the cavity, the top is movable to mate with the periphery of the opening; and the rigid member is smaller than the opening. In a yet further feature, the top has a front margin and an opposed rear margin, a left hand margin and an opposed right hand margin; the top is hingedly connected to the body along the rear margin, and the rigid member spans the top in one direction.

In a still further feature, the rigid member has a first margin portion running along at least part of the left hand margin of the top; a second margin portion running along at least part of the front margin of the top, and a third margin portion running along at least part of the right hand margin of the top. In another feature, the top has a front margin and an opposed rear margin, a left hand margin and an opposed right hand margin; and the rigid member spans the top in one direction.

In still another feature, the top has a first portion and a second portion; the first portion is proximate to the connection of the top to the body; the second portion is distant from the connection to the body; and the second portion includes the rigid member. In a further feature, the container has a secondary closure member that is one of (a) an inset secondary closure member adjacent to the rigid member; and (b) an inset secondary closure member formed amidst the rigid member. In another feature, the secondary closure member is a zipperless closure member, the secondary closure member pivots on a hinged connection, and the secondary closure member is oriented to open toward a largest portion of the work surface.

In still another feature, the body has a front wall, a rear wall, a left hand wall and a right hand wall. The front wall has a width and a height. The rear wall has an upper margin. The top is hingedly connected to the upper margin of the rear wall. The top has a proximal portion adjacent to the upper margin of the rear wall, and a distal portion distant from the upper margin of the rear wall. The distal portion includes the rigid member. The rigid member has a width and length, the width being measured predominantly parallel to the upper margin of the rear wall, and the length being measured cross-wise to the width. The length of the rigid member is one of (a) less than, and (b) equal to, the height of the front wall of the body. In yet another feature, the work surface includes a portion bounded by a peripheral retaining wall, whereby when the rigid member is other than precisely level the retaining wall is operable to discourage objects placed on the work surface from sliding off the work surface.

In still yet another feature, the body is movable between an expanded position and a folded position, the body having securements operable releasably to retain the body in the folded position. In an additional feature, the rigid member overlies an insulated layer portion of the top. In another feature, the top panel has a breadth and a width, and the rigid member has at least one of (a) a breadth less than the breadth of the top panel; and (b) a width that is less than the width of the top. In still another feature, the rigid member spans the top panel in one direction. In another feature, the top has a front edge and an opposed rear edge, a left hand edge and an opposed right hand edge, and the rigid panel spans the top cross-wise between the left hand and right hand edges. In a further additional feature, the rigid member has a margin running along the front edge of the top. In a yet further feature, the rear edge of the top is hingedly connected to the body of the container, and the rigid member has rear margin spaced from the rear edge of the top. In a still further feature, a rearward portion of the top is defined between the rear edge of the top and the rear margin of the rigid member, and the rearward portion of the top is pliable, permitting the rearward portion to bend on a curve.

In another feature, the top has one of: (a) an inset secondary closure member adjacent to the rigid member; and (b) an inset secondary closure member formed amidst the rigid member. In another feature, the secondary closure member is a zipperless closure member, the secondary closure member is pivots on a hinged connection, and the secondary closure member is oriented to open toward a largest portion of the work surface.

In another feature, the top is hingedly mounted to the body of the container. In an additional feature, the body has an upper margin defining a periphery of an opening of the cavity, the top is movable to mate with the periphery of the opening; and the rigid member is smaller than the opening. In another feature, the top has a front margin and an opposed rear margin, a left hand margin and an opposed right hand margin; the top is hingedly connected to the body along the rear margin, and the rigid member spans the top in one direction. In still another feature, the rigid member has a first margin portion running along at least part of the left hand margin of the top; a second margin portion running along at least part of the front margin of the top, and a third margin portion running along at least part of the right hand margin of the top.

In another feature, the top has a front margin and an opposed rear margin, a left hand margin and an opposed right hand margin; and the rigid member spans the top in one direction. In yet another feature, the top has a first portion and a second portion; the first portion is proximate to the connection of the top to the body; the second portion is distant from the connection to the body; and the second portion includes the rigid member. In still another feature, the container has a secondary closure member that is one of (a) an inset secondary closure member adjacent to the rigid member; and (b) an inset secondary closure member formed amidst the rigid member. In an additional feature, the secondary closure member is a zipperless closure member, the secondary closure member is pivots on a hinged connection, and the secondary closure member is oriented to open toward a largest portion of the work surface.

In another feature, the body has a front wall, a rear wall, a left hand wall and a right hand wall. The front wall has a width and a height. The rear wall has an upper margin. The top is hingedly connected to the upper margin of the rear wall. The top has a proximal portion adjacent to the upper margin of the rear wall, and a distal portion distant from the upper margin of the rear wall. The distal portion includes the rigid member. The rigid member has a width and length, the width being measured predominantly parallel to the upper margin of the rigid member, and the length being measured cross-wise to the width; and the length of the rigid member is one of (a) less than, and (b) equal to, the height of the front wall of the body. In another feature, the work surface includes a portion bounded by a peripheral retaining wall, whereby when the rigid member is other than precisely level the retaining wall is operable to discourage objects placed on the work surface from sliding off the work surface.

In still the body has a front wall, a rear wall, a left hand wall and a right hand wall. The front wall has a width and a height. The rear wall has an upper margin. The top is hingedly connected to the upper margin of the rear wall. In the expanded position, the body has an upper margin defining a periphery of an opening of the cavity, the top is movable to mate with the periphery of the opening; and the rigid member is smaller than the opening. The top has a proximal portion adjacent to the upper margin of the rear wall, and a distal portion distant from the upper margin of the rear wall. The distal portion includes the rigid member. The rigid member has a width and length, the width being measured predominantly parallel to the upper margin of the rear wall upper margin, and the length being measured cross-wise to the width. The length of the rigid member is one of (a) less than, and (b) equal to, the height of the front wall of the body; and in the folded position of the body the first portion of the top panel curves over the folded body, and the rigid member lies in front of the front wall of the body with the work surface facing outwardly and forwardly. In another feature, the container has a secondary closure member that is one of (a) an inset secondary closure member adjacent to the rigid member; and (b) an inset secondary closure member formed amidst the rigid member. In an additional feature, the secondary closure member is a zipperless closure member, the secondary closure member pivots on a hinged connection, and the secondary closure member is oriented to open toward a largest portion of the work surface.

In another aspect of the invention, there is a soft-sided insulated container having a rigid member defining a work surface upon which to rest objects. The body is collapsible and is movable between a collapsed position and a non-collapsed position. The top includes a second closure member, the second closure member being smaller than the first closure member. The rigid member is movable between a first position and a second position, the first position being a retracted position, the second position being a deployed position; and when the body is in the non-collapsed position, and the work surface member is in the deployed position, the secondary closure member is free of obstruction by the work surface member.

In a feature of that aspect of the invention, the rigid member defining the work surface includes a folding shelf. In an alternate feature, the rigid member is movable in linear translation relative to the lid. In another feature, the work surface spans the lid in at least one of (a) a side-to-side direction; and (b) a front-to-back direction.

In another aspect of the invention there is any combination of any of the features of any one of embodiments shown or described herein, in combination with the features of any other embodiment shown or described herein, except to the extent those features are mutually exclusive. In another aspect of the invention, there is any apparatus substantially as shown or described herein, in whole or in part.

BRIEF DESCRIPTION OF THE DRAWINGS

These aspects and other features of the invention can be understood with the aid of the following illustrations of a number of exemplary, and non-limiting, embodiments of the principles of the invention in which:

FIG. 7*g* FIG. 7*f* is a perspective view of the shelf assembly of FIG. 7*e* in a partially unfolded position;

DETAILED DESCRIPTION

Figure 3A:
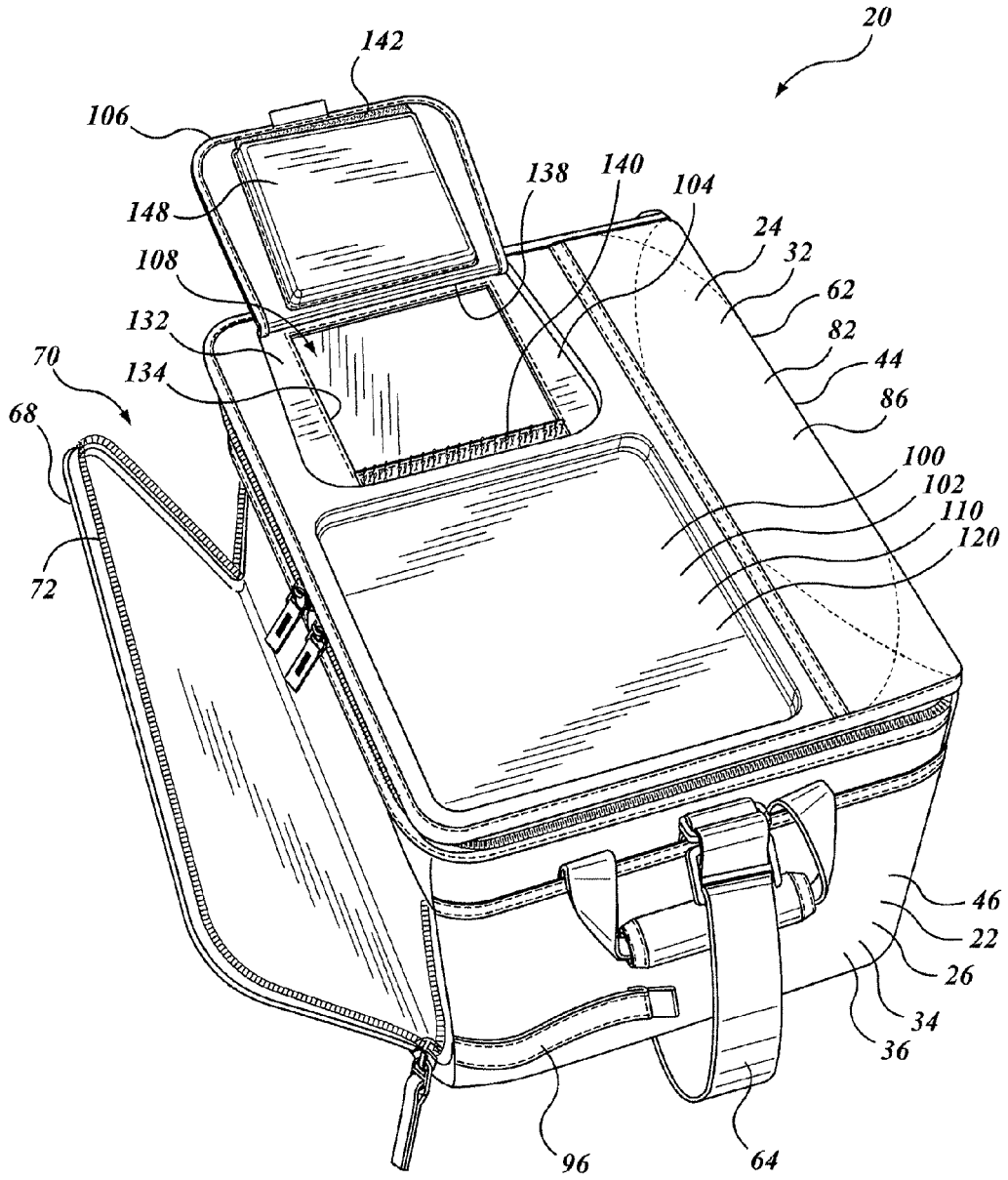
FIG. 3*a* shows an isometric view of the container assembly of FIG. 1*a*, showing an auxiliary closure member of the top panel in an open condition, and showing a front auxiliary compartment closure member in an open position.
Figure 3B:
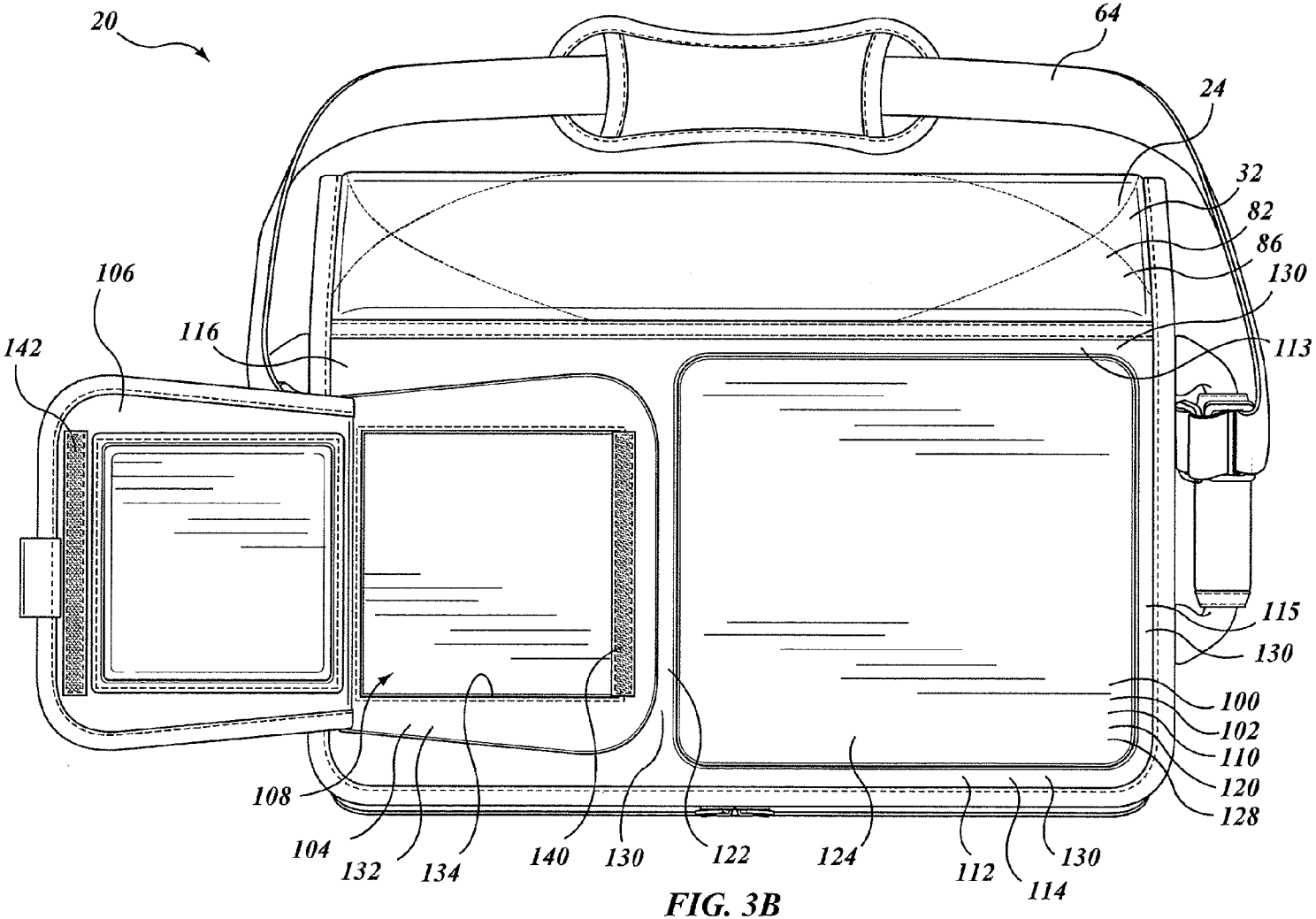
FIG. 3*b* shows a top view of the container assembly of FIG. 3*a* from above with its auxiliary closure member in an open position.
Figure 3C:
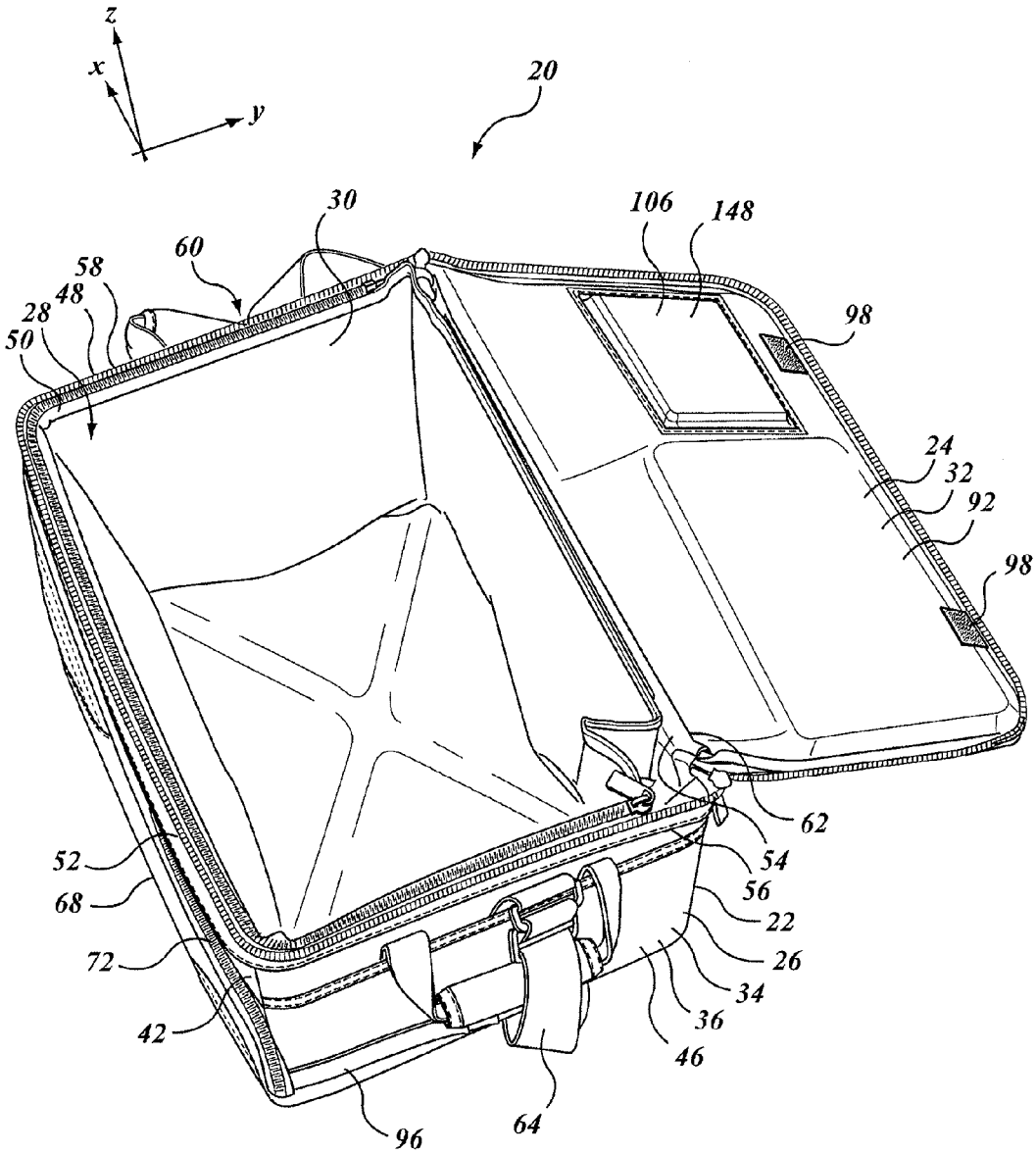
FIG. 3*c* shows the container assembly of FIG. 3*a* from above and to the left with the main closure member thereof in a fully open condition.
Figure 3D:
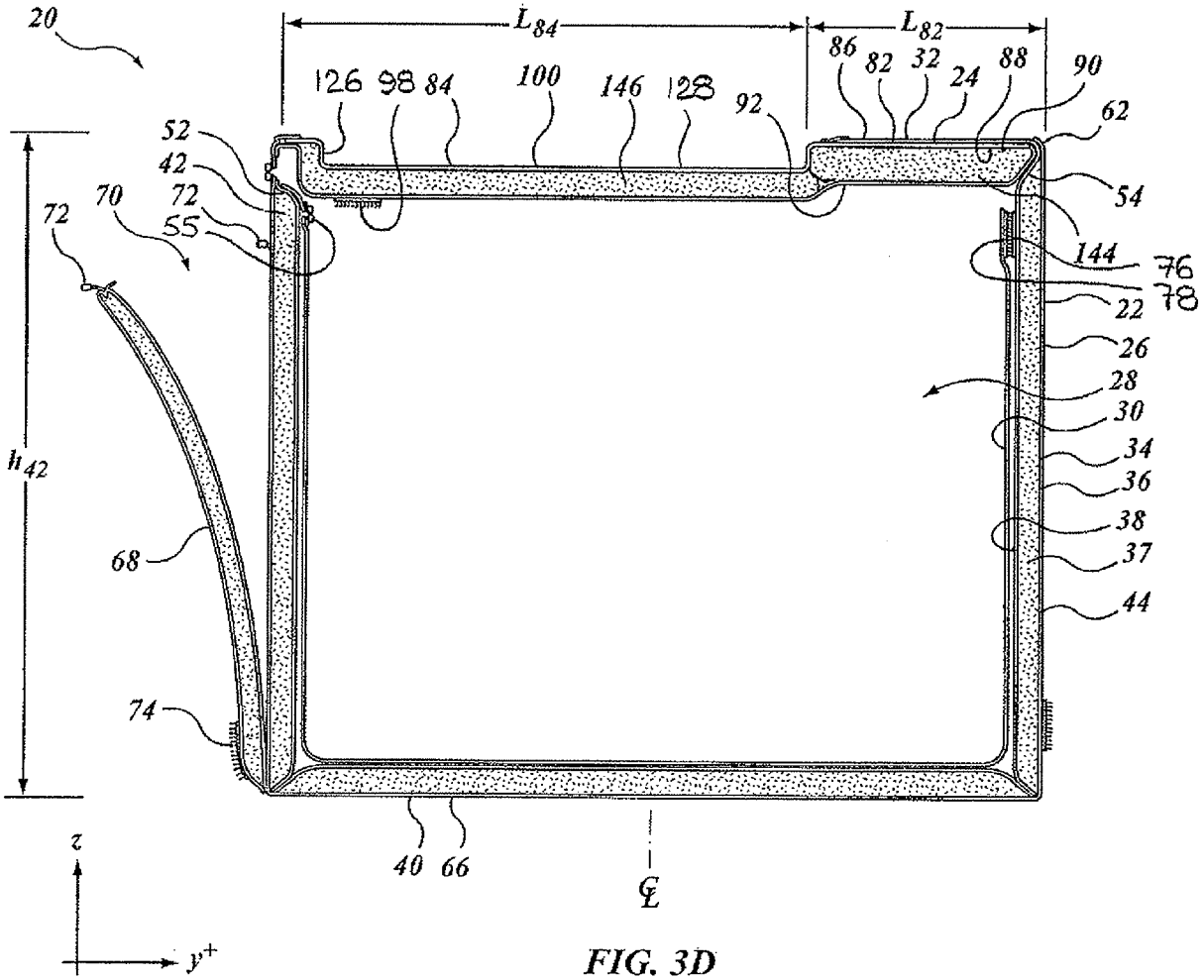
FIG. 3*d* is a cross-sectional view of the container assembly of FIG. 1*a*; taken on section '3*d*-3*d*' of FIG. 1*c;*
Figures 4A, 4B, 4C, 4D:
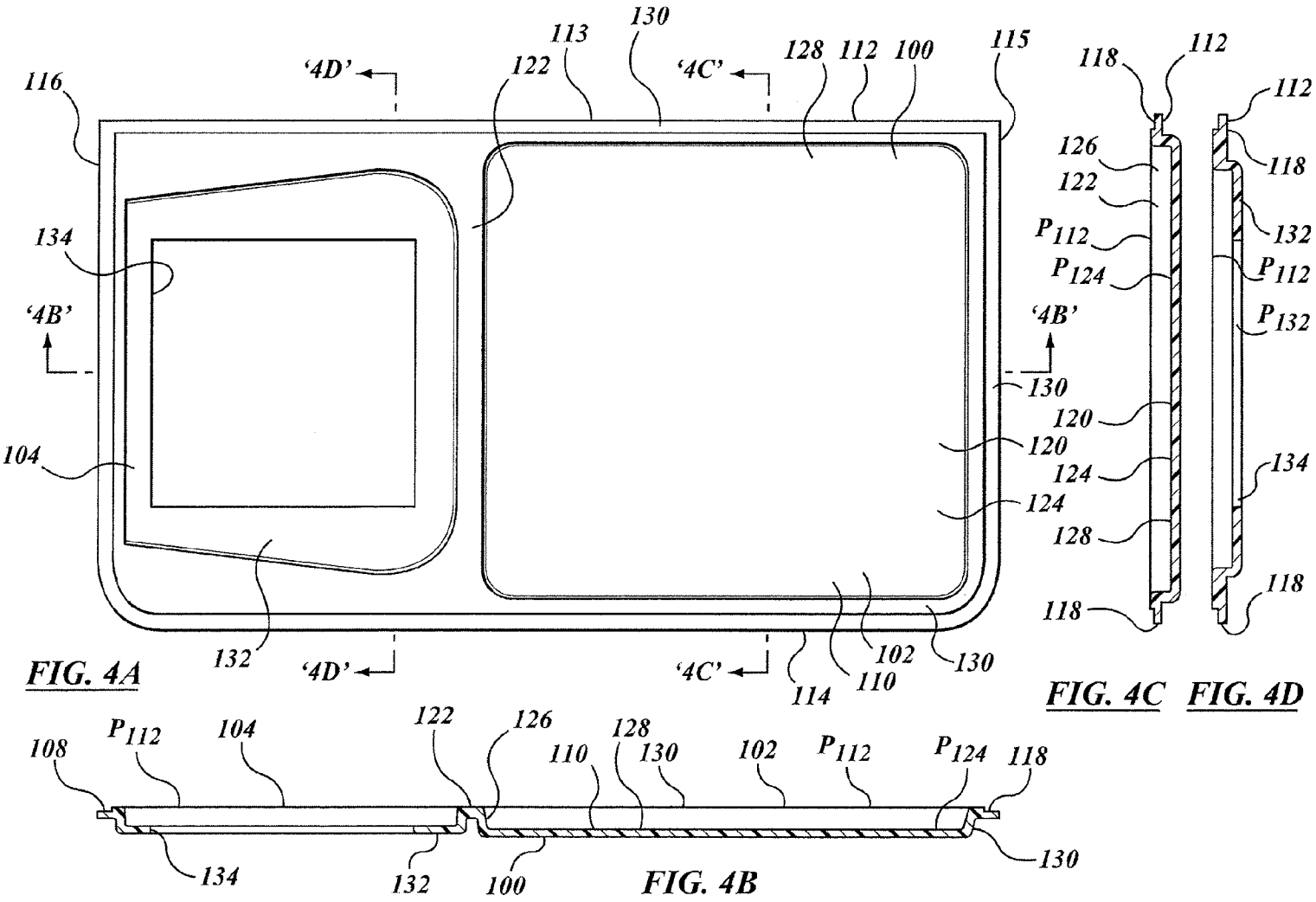
FIG. 4*a* is a top view of a substantially rigid member of the container of FIG. 1*a;*
FIG. 4*b* is a view on a lengthwise cross-section of the member of FIG. 4*a* taken on section '4*b*-4*b'*.
FIG. 4*c* is a view on a lengthwise cross-section of the member of FIG. 4*a* taken on section '4*c*-4*c'*.
FIG. 4*d* is a view on a lengthwise cross-section of the member of FIG. 4*a* taken on section '4*d*-4*d'*.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings may be understood to be to scale and in proportion unless otherwise noted. FIG. 3*d* is not drawn to scale 9 for example. The wording used herein is intended to include both singular and plural where such would be understood, and to include synonyms or analogous terminology to the terminology used, and to include equivalents thereof in English or in any language into which this specification many be translated, without being limited to specific words or phrases.

For the purposes of this description, it may be that a Cartesian frame of reference may be employed. In such a frame of reference, the long, or largest, dimension of an object may be considered to extend in the direction of the x-axis, the base of the article, where substantially planar, may be considered to extend in an x-y plane, and the height of the article may be measured in the vertical, or z-direction. When the container assembly is sitting on its bottom panel, the largest predominantly upstanding panels may be designated arbitrarily as the front and rear sides, faces, or portions of the container. Similarly, the closure member, or opening, of the bag is arbitrarily designated as being at the top, and the base panel is designated as being at the bottom, as these terms may be appropriate for the customary orientation in which the objects may usually be found, sold, or employed, notwithstanding that the objects may be picked up and placed on one side or another from time to time at the user's choice. It should also be understood that, within the normal range of temperatures to which human food and human touch is accustomed, although the term cooler, or cooler container, or cooler bag, may be used, such insulated structures may generally also be used to keep food, beverages, or other objects either warm or hot as well as cool, cold, or frozen. Unless noted otherwise, the terms "inside" and "outside", "inwardly" and "outwardly", refer to location or orientation relative to the enclosed spaces of the container assembly, as may be.

In this specification reference is made to insulated containers. The adjective "insulated" is intended to be given its customary and ordinary meaning as understood by persons skilled in the art. It is not intended to encompass single layers, or skins, of conventional webbing materials, such as Nylon™, woven polyester, canvas, cotton, burlap, leather, paper and so on, that are not otherwise indicated as having, or being relied upon to have, particular properties as effective thermal insulators other than in the context of being provided with heat transfer resistant materials or features beyond that of the ordinary sheet materials in and of themselves. In this description, when an item, or structure, or wall, is indicated as being insulated, such term is understood to mean that the wall has a layer of insulation, as distinct from merely being a layer of plastic or canvas, or paper or cardboard, or webbing in and of itself by virtue of its own resistance to heat transfer. For example, an insulated wall may have an outer surface or skin, or covering, which, in the context of soft-sided insulated containers may be a layer of nylon, which may be a woven or textured nylon. The wall may have an inner surface or skin, or covering, such as a vinyl liner or sheet. A layer of insulating material which may typically be a closed-cell or open cell foam, may be captured between the inner and outer skins. This commentary is provided to supplant any dictionary definition, and to prevent interpretation in any Patent Office that strays from the customary and ordinary meaning of the term "insulated" as provided herein.

Similarly, this description may tend to discuss various embodiments of soft-sided containers, as opposed to hard shell containers. In the jargon of the trade, a soft sided cooler, or bag, or container, is one that does not have a substantially rigid, high density exoskeleton (typically a molded shell, e.g., of ABS or polyethylene, or other common types of molded plastic). Rather, as noted, a soft-sided insulated container wall may tend to have, for example, an outer skin, a layer of insulation, and an internal skin, both the internal and external skins being of some kind of webbing, be it a woven fabric, a nylon sheet, or some other membrane. The layer of insulation, which may be a sandwich of various components, is typically a flexible or resilient layer, perhaps of a relatively soft and flexible foam.

A soft-sided container may still be a soft-sided container where, as described herein, it may include one or more substantially rigid internal liners that seat within the soft-sided wall structure, or it may include one or more battens (which may be of a relatively hard plastic) concealed within the soft sided wall structure more generally, or where hard, moulded, fittings may be used whether at a container rim or lip, or to provide a base or a mounting point for wheels, but where the outside of the assembly is predominantly of soft-sided panels. Again, this definition is intended to forestall interpretation by any patent office of the term "soft-sided" in a manner that diverges from the ordinary and customary meaning of the term as understood by persons of ordinary skill in the art in the industry, and as explained herein.

Further, in this description, when an object is indicated as being collapsible, the meaning is of being intentionally collapsible, or foldable, as opposed to being something the will crush if subject to sufficient force. A collapsible container is one that moves between a known, collapsed position, and a known deployed, or expanded, position.

Referring to the Figures, and by way of a general overview, a soft-sided insulated container assembly is indicated generally as 20. Container assembly 20 has a first, or main, portion, or body, 22, and a second part or portion, 24, that co-operates with first portion 22. Typically, the main portion or body 22 has a wall structure, or outer casing, 26 that defines an internal volume, or cavity, receptacle, or chamber, 28, however it may be termed, for receiving objects such as may be desired to be kept cool or warm, a variety of such objects being indicated in FIG. 1*a* as 'A' and 'B'. Outer casing 26 may be in the nature of a soft-sided, insulated wall structure 34, as described below. Second portion 24 may be, or include, a top wall or top panel that defines a closure member, or lid, 32, movable between open and closed positions to govern access to the interior of main body 22. Lid 32 may define a first main or primary closure member of container assembly. Where it is desired to contain liquids, container assembly 22 may include a liner 30 for use within wall structure 26. To the extent that main body, or portion, 22 includes an internal liner 30, in one embodiment that liner 30 may be made by folding a monolithic plastic sheet, typically a clear plastic vinyl sheet, with the corners folded as shown and described in U.S. Pat. No. 6,582,124 issued Jun. 24, 2003. Liner 30 may have an upper margin, and may be releasably secured at that upper margin by a tracked fastener, or by hook-and-eye fabric strip fasteners, or a combination thereof, such that liner 30 is watertight, and is removable from within wall structure 28, and of container assembly 20 more generally, for example to facilitate washing or replacement thereof.

Outer Casing 26

Outer casing 26 may be made of an insulative material 37 for thermally insulating chamber 28. The insulative material 37 may be located between an outer covering 36 and an inner surface sheet 38. The insulative material inhibits heat transfer between chamber 28 and the surroundings of container assembly 20. This may tend to help to maintain a temperature of items such as food products stored within the receptacle, i.e., chamber 28, whether cooler or warmer, as may be. When lid 32 is in a closed position, heat transfer may be inhibited to a greater extent. Insulative material 37 may additionally be soft, such as a resilient foam, whether closed cell or open cell, so that the container may tend not to damage, or be damaged by, objects with which it may come into contact. If a suitable plastic or other material or stain resistant surface coating or surface treatment is used, then outer casing 26 may also be readily cleaned to remove dirt and other debris acquired through use.

Outer casing 26 may have an insulated bottom panel 40, and insulated wall panels, namely a front panel 42, a rear panel 44, and a pair of left-hand and right-hand end panels, or side panels, 46 and 48. The choice of front and rear, left and right, is arbitrary. However, for the purposes of this description rear panel 44 may be understood as the panel having an upper margin to which lid 24 is attached, and front panel 42 is the panel opposed to rear panel 64 and distant therefrom. Although other embodiments can be made, typically, the front and rear panels may lie predominantly in x-z planes; the end or side panels may lie predominantly in y-z planes, and the bottom panel may lie predominantly, in an x-y plane, the various wall panels co-operating to define five sides of a box, with an internal cavity, or volume, for receiving objects to be kept warm or cool as may be, identified as chamber 28. Each panel 40, 42, 44, 46 and 48 may be located at substantially right angles to two adjacent wall panels. For example, panel 44 is located adjacent panel 46 at one end, and adjacent panel 48 at an opposite end. The bottom panel may be attached to all four panels 42, 44, 46 and 48, along edges thereof. Bottom panel 40 and panels 42, 44, 46 and 48, may typically be rectangular, with respective opposite panels 42 and 44, and 46 and 48. In this configuration, chamber 28 is a generally cube-like. Panels 42, 44, 46 and 48, and bottom panel 40 may be fastened to one another by sewing, gluing or some other suitable fastening means. The front, left hand side and right hand side panels 42, 46 and 48, may be made from a single piece of insulated material. Lid 32, rear panel 44 and bottom panel 40 may also be formed from a single piece of material. For example, rear panel 44 and lid 32 may be formed from a single piece of material having a fold therein, as at hinge 62, to define rear panel 44 and lid 32. It may be noted that lid 32 may thusly be connected to the upper margin of rear panel 44 by a flexible fabric hinge.

In alternative embodiments, outer casing 26 may have either less than four, or more than four, predominantly upright panels (not shown). For example, outer casing 26 may be configured to have one continuous panel defining a round wall, thereby forming a right cylinder, or some other generally rounded shape.

Chamber 28 may have a lip or rim, 50, which may define the main or primary opening 60 through which objects may be introduced into or withdrawn from chamber 28 of container assembly 20. Panels 42, 44, 46 and 48 may each have an upper, or distal, edge or margin 52, 54, 56 and 58, respectively, which in the case of edges or margins 52, 56 and 58 is also a free edge. Margin 54 may be, or may terminate at, a hinge 62, which may be a fabric or web hinge. The four margins 52, 54, 56 and 58 co-operate to define a periphery bounding main container opening 60. Lid 32 is hingedly, or pivotally attached to rear panel margin 54, as indicated at hinge 62, and is movable pivotally about its rearward hinged edge between the closed, or sealed position, and an open, and unsealed, position, thereby governing access the interior of the assembly, namely to chamber 28 and thereby to permit or obstruct the introduction or withdrawal of objects to be received in the container. In the closed position, lid 32 may be secured in place by a tracked closure member, such as the zipper shown in the illustrations. Outer casing 26 may have a lifting member, such as a shoulder strap 64 attached thereto, for example, at side panels 46 and 48.

FIG. 3*d*, in which thicknesses may have been exaggerated as the purpose of illustration shows the general structure of a cross-section of any of the insulated wall panels, revealing the layers of construction. With the exception of auxiliary pouch 24, this section is typical not only of front panel 42 but also, generally, of rear panel 44, side panels 46 and 48, bottom panel 40. The outer layer, or facing, or covering, 36, of the panel (be it 42, 44, 46 or 48) is an outer skin which in the nature of a nylon, woven nylon, canvas or other covering layer 68, which may tend to be abrasion resistant. It overlays an intermediate thermal insulation medium, such as may be in the nature of closed cell foam insulation layer 37 for impeding, which is to say discouraging, heat transfer between the interior of container assembly 20 and external ambient. The inner face of the insulated wall panel, namely inner surface sheet 38, may be an inner skin which may be in the nature of a flexible sheet, whether of Vinyl™ or of plasticised metallic foil sheeting that is shiny and reflective. The metallic foil sheeting material may be the type sold under the name Therma-Flect™. This same general structural arrangement prevails in bottom panel 40, although outer covering layer 66 may be a rather thicker, scuff-resistant material than the outer skin of the upwardly extending side walls.

Container assembly 20 may include a further, or secondary, wall panel, or wall panel assembly 68 that may be mounted to the front face of front panel 42 to define a secondary enclosure, chamber, pocket, pouch, receptacle or compartment, however it may be named, indicated at 70. Although the embodiment of wall panel assembly 68 shown is insulated, in other embodiments this insulation may be optional. Wall panel assembly may extend across substantially the entire width of front panel 42, or only a portion thereof, and may extend over substantially the full height of wall panel 42, or a lesser portion thereof. Some embodiments of container assembly 20 may not include wall panel assembly 68. Wall panel assembly 68 may include a closure member, and that closure member may include a tracked fastener, such as a zipper, or such other fastening fitting or fittings as may be appropriate, indicated as 72. The lower portion of wall panel assembly 68, or if no such wall panel 68 is used, then the lower portion of front panel 42, may have securement fittings, such as indicated at 74.

To the extent that a liner 30 is employed, it may be a folded vinyl liner, which may be a clear vinyl liner, and liner 30 may be removable and washable. Liner 30 may have the same generally box-shaped form as chamber 28, and may fit therewithin accordingly. The top side of liner 30 is typically open, corresponding to opening 60, and the upper edge or periphery of liner 30 may typically be sewn into a seam. It may have a zipper half 55 sewn along the edges of three sides, those three sides mating with the opposing zipper half of zipper 55 mounted to the three free edges, at respective upper margins 52, 56 and 58, of casing 26. The upper edge, margin 54, of the rear wall of liner 30 may include a hook-and-eye fabric fastening strip (e.g., Velcro™) as at 76 for mating with a corresponding hook-and-eye fabric fastening strip 78 mounted to the upper margin of the inside face of rear panel 44.

Turning now to the top panel of container assembly 20, namely that panel defining lid 32, as noted it is movable between first and second positions, one position being relatively more obstructive of opening 60 than the other. The top panel, or lid, 32 may be sized generally to fit opening 60. That is, to the extent that opening 60 can be said to have a shape and size, which may be taken as a projection in the z-direction such as may give a footprint of that opening, lid 32 may have a corresponding shape and size or footprint. In some embodiments the footprint of opening 60, and lid 32, may correspond also to the footprint of bottom panel 40.

Lid 32 may have a first portion, 82, and a second portion 84. Taking the juncture of hinge 62 at the upper margin 54 of rear panel 44 as a reference datum, first portion 82 may be referred to as a proximal portion, and second portion 84 may be referred to as a distal portion. From outside to inside, proximal portion 82 may include an outer surface layer 86, a flexible reinforcement or batten 88, a layer of insulation, 90, and an inner surface layer 92. Outer surface layer 86 may be a flexible fabric web, or plastic sheet, which may be a woven fabric. The flexible reinforcement, 88, which may be employed in some embodiments, may tend to function to protect the layer of insulation, and also to function as a spring. Flexible reinforcement 88, when used, may be placed either inside or outside layer of insulation 90 and functions to provide a higher resistance to bending than merely insulation layer 90 by itself, such that first portion 82 is more resistant to bending than the soft-sided wall structure generally, and may tend to form a curve, or curl, rather than a crease, when bent. It may be noted that while reinforcement 88 is soft, or springy, or complaint, in bending out-of-plane, namely-out-of-the-x-y plane, (as when lid 32 is folded about the other panels in the collapsed and secured configuration shown in FIGS. 2*a*, 2*b*, 2*c*, 2*h* and 2*i*, reinforcement 88 is relatively stiff in resisting in-plane (i.e., in the x-y plane) shear in the x-direction (i.e., as when a shear force in the −x direction is placed upon the proximal margin of reinforcement 88 at hinge 62, and a reaction shear force in the +x direction is placed upon the corresponding distal margin of reinforcement 88).

In some embodiments container assembly 20 may be collapsible. That is, in those embodiments container assembly 20 is movable between a first position, which may be identified as the expanded or deployed condition or position shown in the first series of FIGS. 1*a* to 1*h*, and a second position, which may be identified as a collapsed or retracted or folded, or storage position, whatever terminology may be used, as shown in the second series of FIGS. 2*a*-2*i*. Those first and second positions are pre-determined, deliberate, repeatable configurations of container assembly 20. Container assembly 20 may include securements, or securement fittings 94, which may be hook-and-eye fabric strips, that are engaged by mating fasteners such as found at the end of retaining straps 96, whereby the container assembly 20 is secured in the collapsed position or condition. The distal margin of lid 32 may similarly have lid underside securement fittings 98 for engagement in the collapsed position with securement fittings 74. It may be noted that in the folded position front panel 42 maintains, or substantially maintains, a generally planar and parallel orientation relative to rear panel 44 (keeping in mind the general flexibility of the structure, the extent to which the panels are either planar or precisely parallel is approximate). In collapsing, however, side panels 46 and 48, and bottom panel 40, fold as seen in FIGS. 2*a*, 2*b*, 2*c*, 2*g*, 2*h* and 2*i*. As folded, the spacing of the front face of front panel 42 from the front face of rear panel 44 is then a function of the double-folded thickness of the side panels 46, 48 plus the thickness of front panel 42.

In the expanded or deployed position, container assembly may be in its accustomed form of a generally cube-like squarish or rectangular box. In this position or condition, lid 32 pivots between open and closed positions on hinge 62, and may have a generally flat condition. By contrast, in the collapsed or folded position the distance in the y-direction from the front face of rear panel 44 to the front face of front panel 42 is non-trivial. However, in this condition proximal portion 82 functions, in effect, as a large extended hinge that curves or curls over or reaches about, the other elements of container assembly 20, the reach of proximal portion 82 being sufficient to permit distal portion 84 to seat against, front panel 42, and to be secured thereto by the engagement of lid underside securement fittings 98 with securement fittings 74.

Second portion 84 may define or include a substantially rigid member 100, having a work surface. That work surface may be referred to for convenience as a table top, 110. In some embodiments, second portion 84 (and hence table top 110), may amount to all, or nearly all, of lid 32 from hinge 62 to the most distant extremity of lid 32 (that is, there may be little or no "first portion"). Alternatively, the relative proportions of first portion 82 to second portion 84, in terms of respective lengths in the x-direction, $L_{82}$ and $L_{84}$, may be in the range of $0<L_{82}/L_{84}<1/2$, and perhaps $1/5<L_{82}/L_{84}<2/5$, and perhaps more narrowly, $1/4<L_{82}/L_{84}<1/5$, it being understood that the length of lid 32 in the y-direction may generally be the sum of $L_{82}$ and $L_{84}$.

Figure 1A:
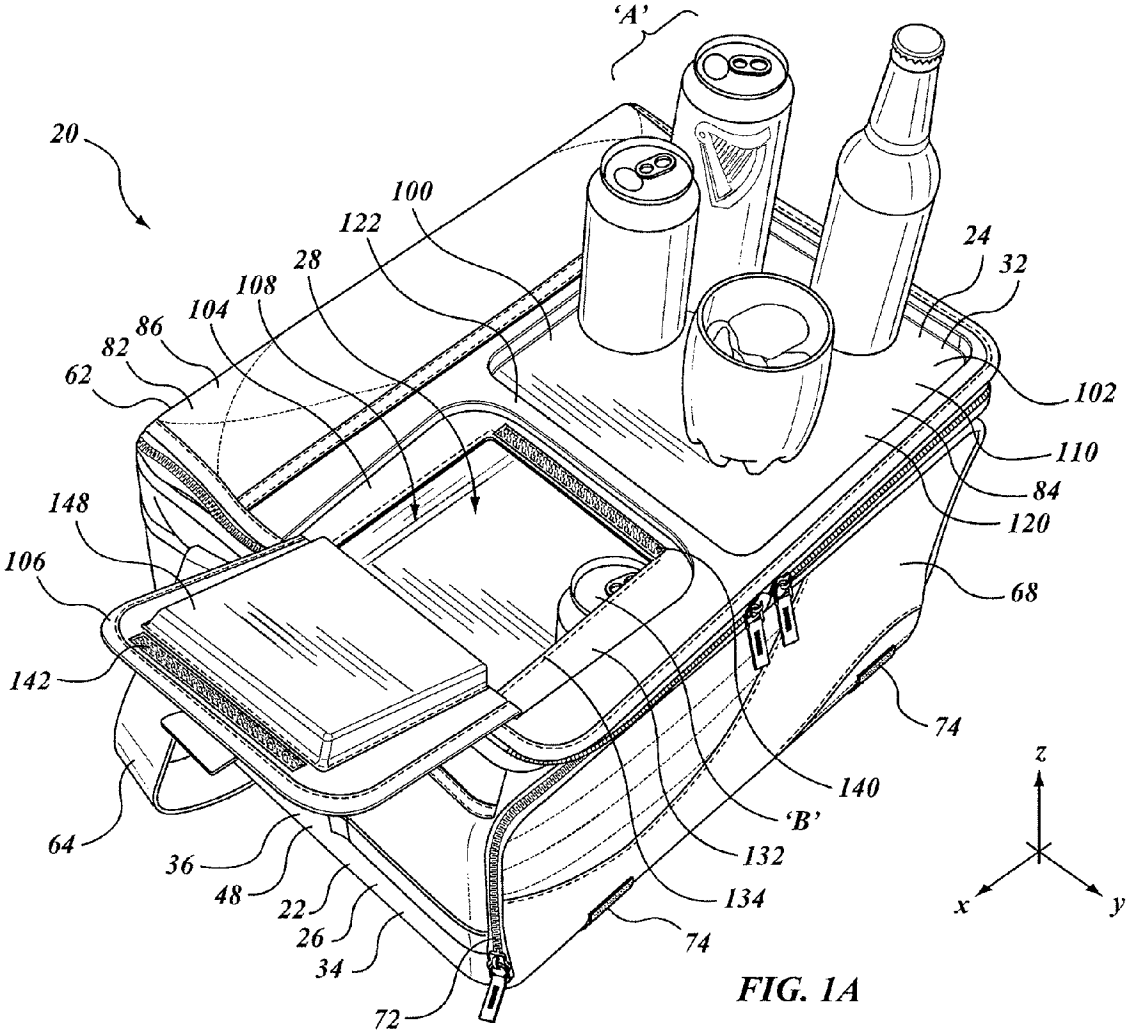
FIG. 1*a* shows a perspective view taken from in front, above, and to the right, of an embodiment of a soft-sided container assembly according to an aspect of the present invention, the assembly being shown in an expanded condition and with its auxiliary closure member open.
Figure 1B:
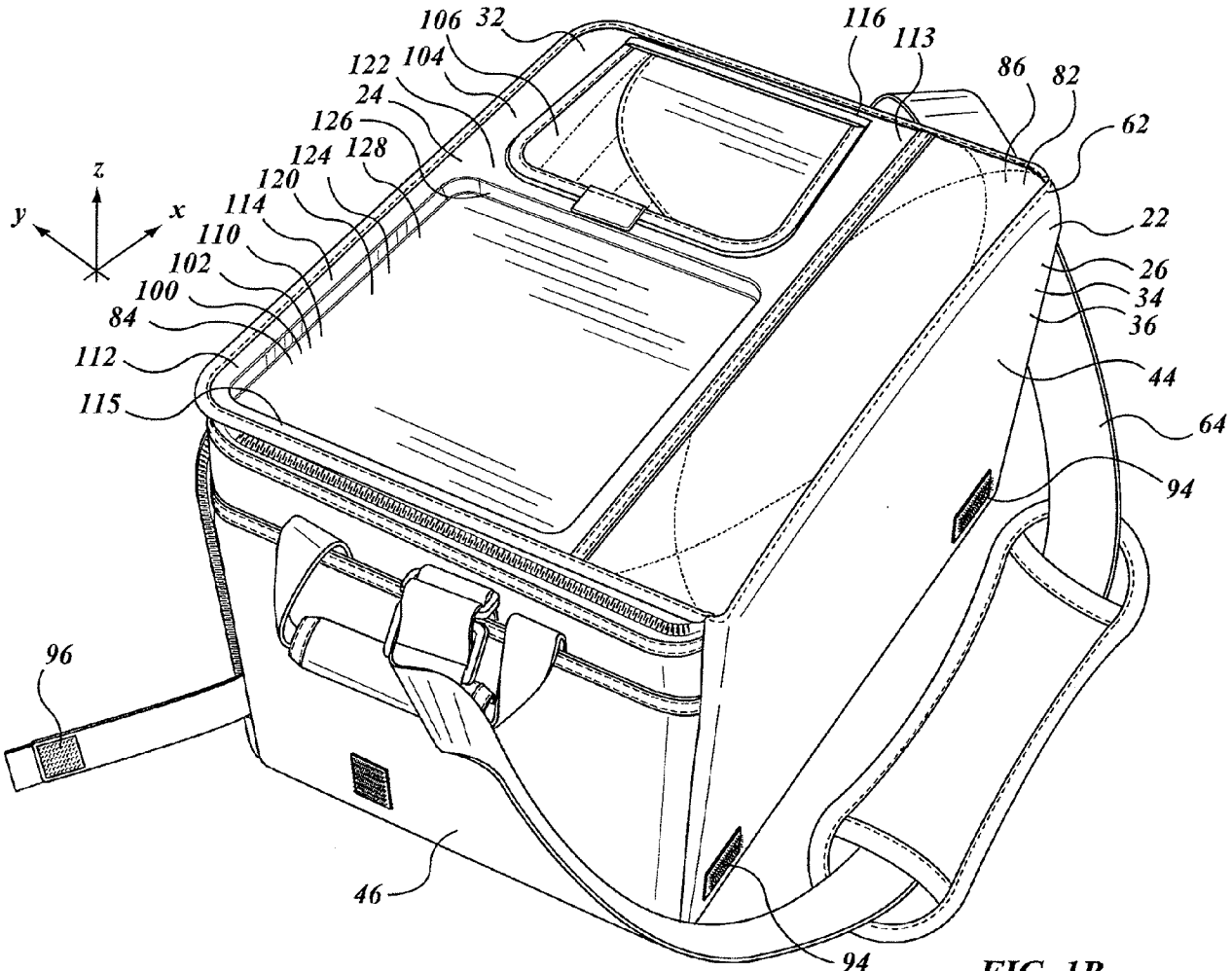
FIG. 1*b* shows the container assembly of FIG. 1*a* in a perspective view taken from above on the opposite diagonal to that of the perspective view of FIG. 1*a* and with the auxiliary closure member closed.
Figure 1C:
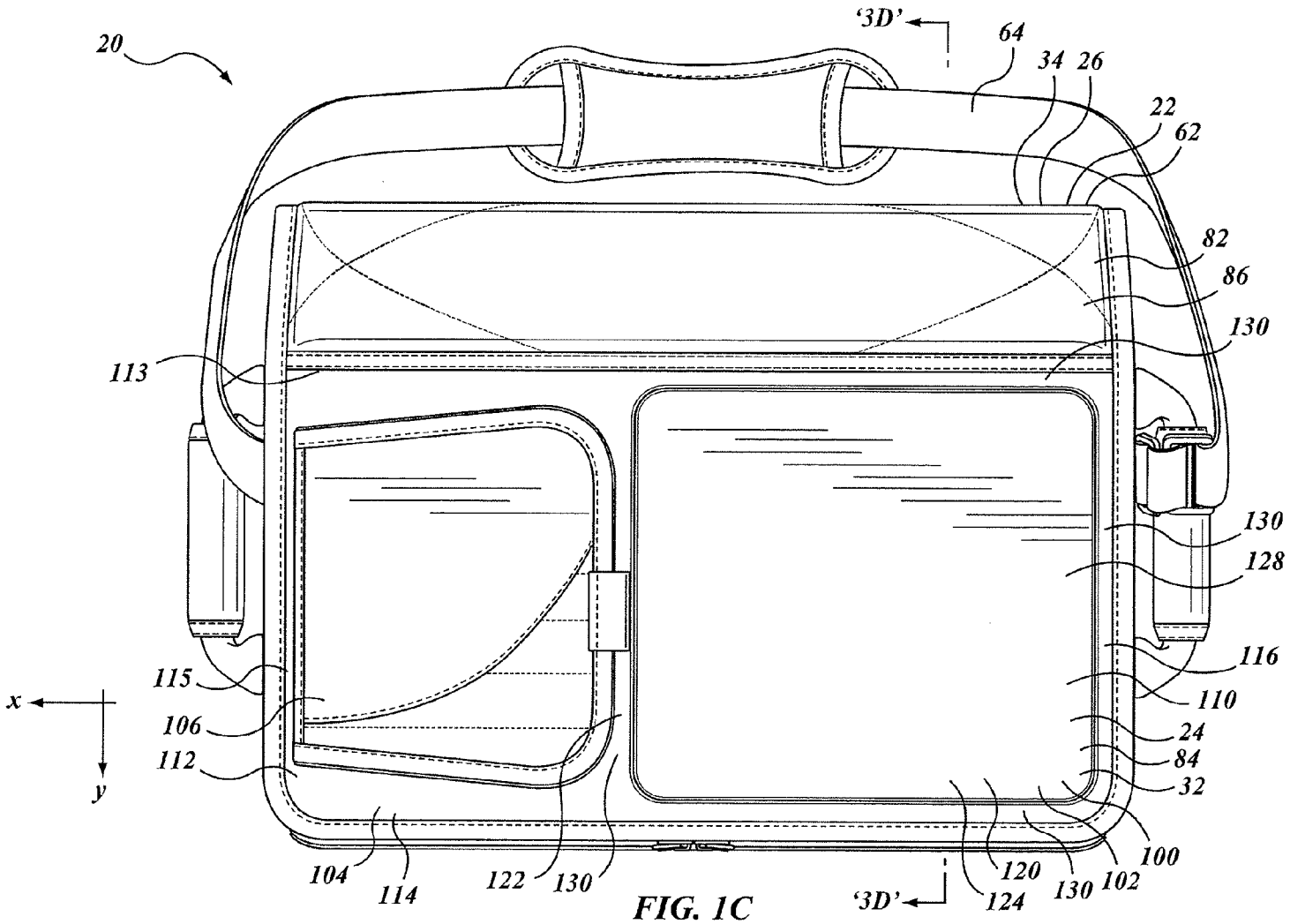
FIG. 1*c* shows a top view of the container assembly of FIG. 1*a;*
Figure 1D:
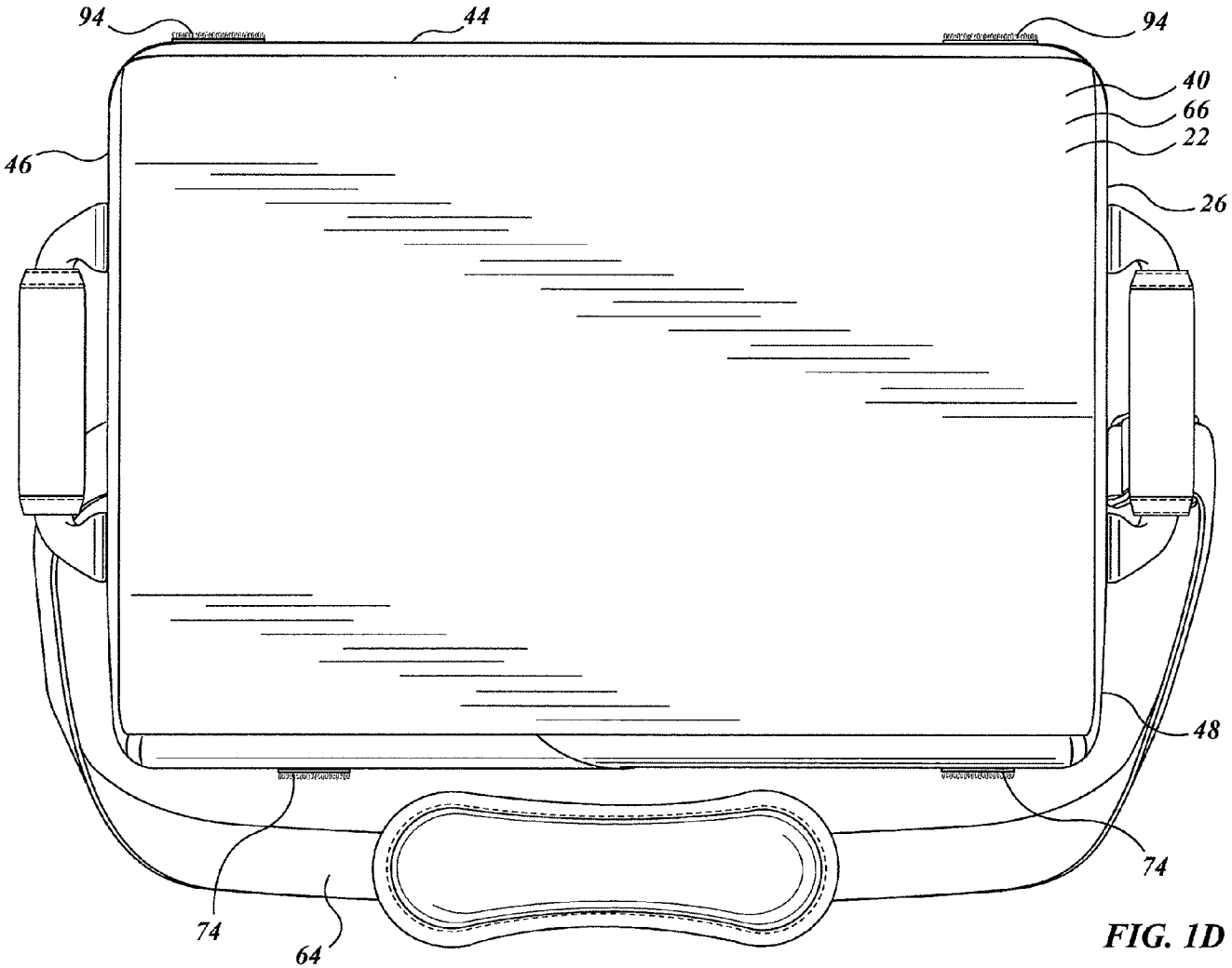
FIG. 1*d* shows a bottom view of the container of FIG. 1*a;*
Figure 1E:
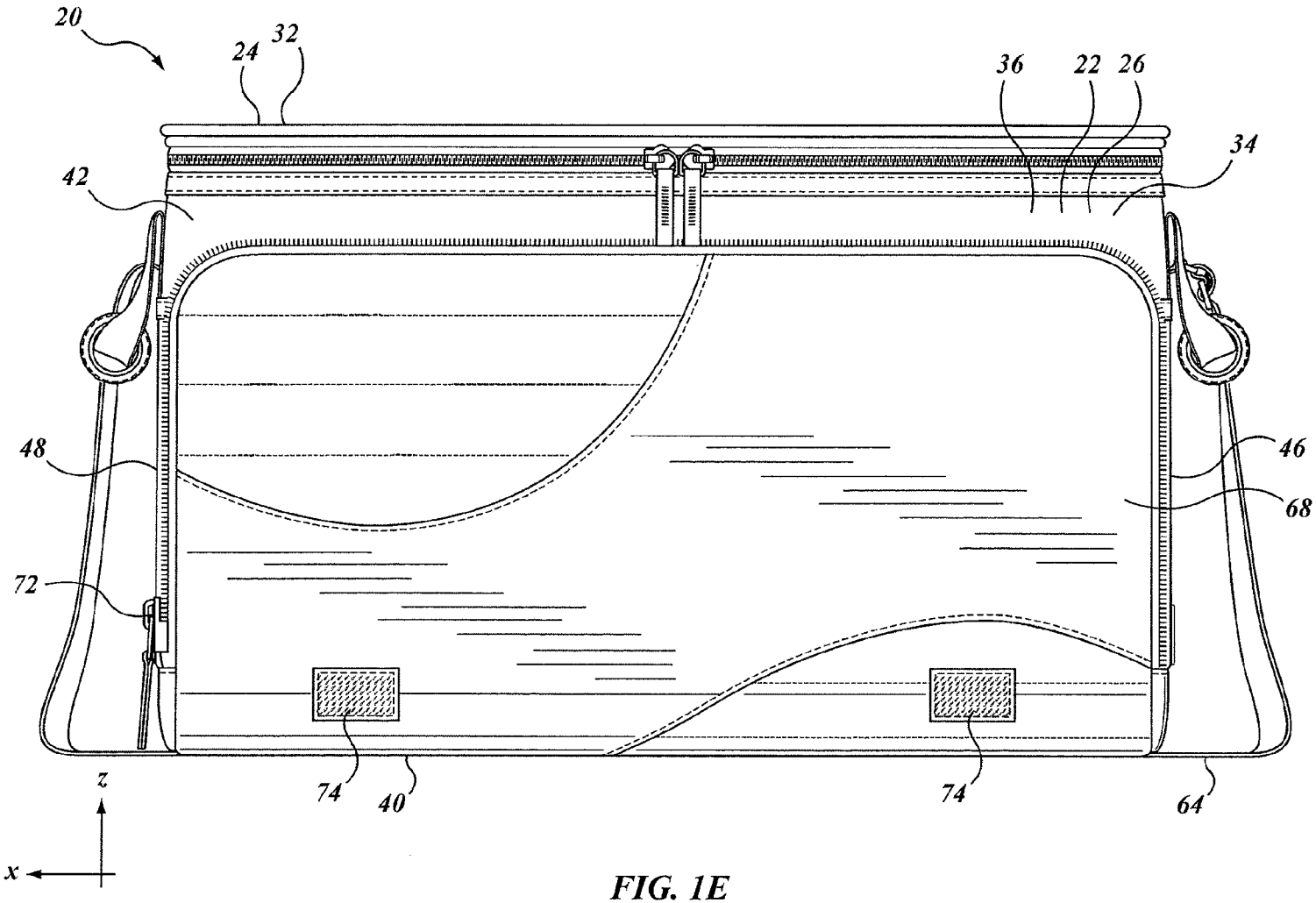
FIG. 1*e* is a front view of the container assembly of FIG. 1*a;*
Figure 1F:
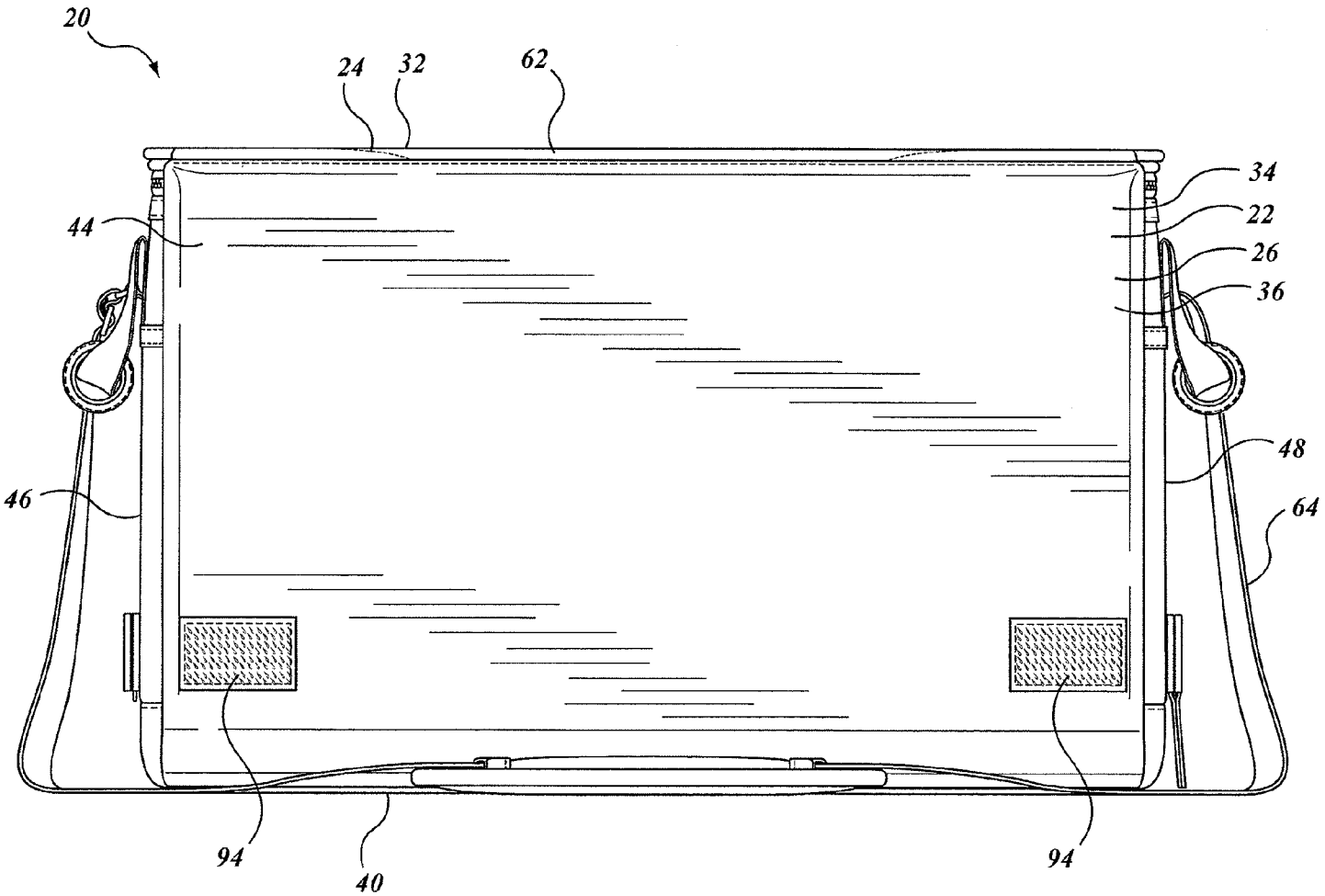
FIG. 1*f* is a rear view of the container assembly of FIG. 1*a;*
Figure 1G:
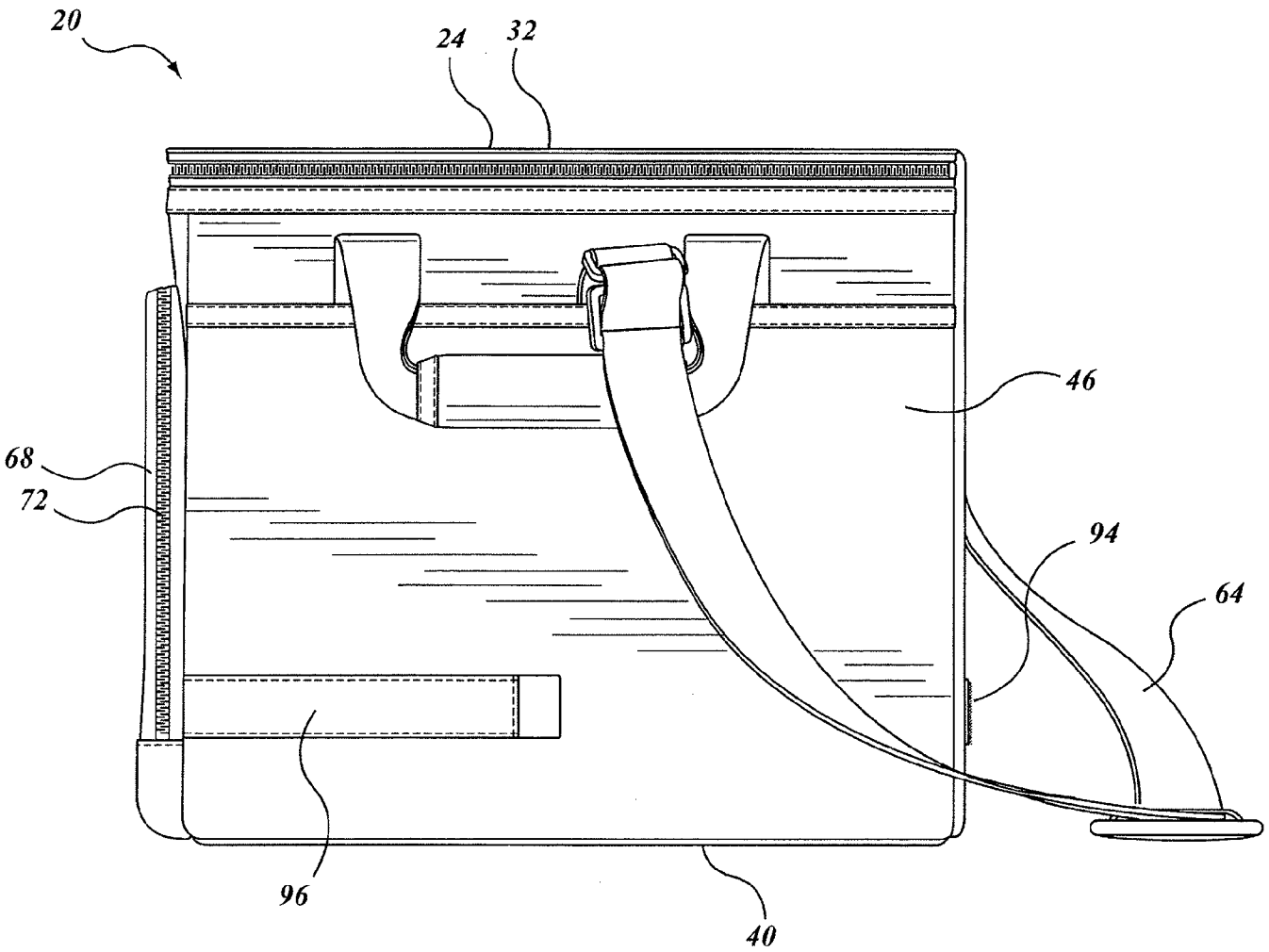
FIG. 1*g* is a left hand view of the container assembly of FIG. 1*a;*
Figure 1H:
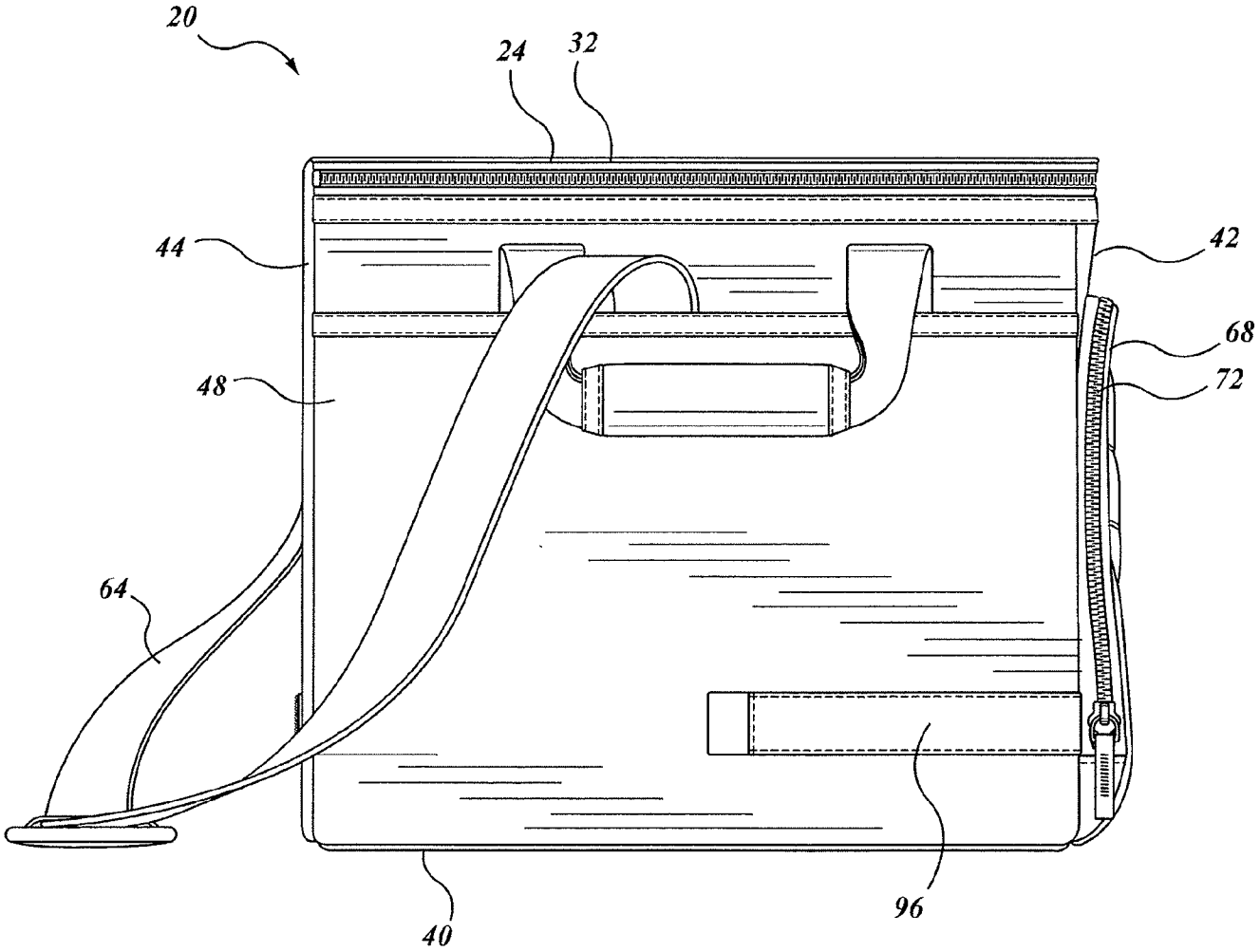
FIG. 1*h* is a right hand view of the container assembly of FIG. 1*a;*
Figure 2A:
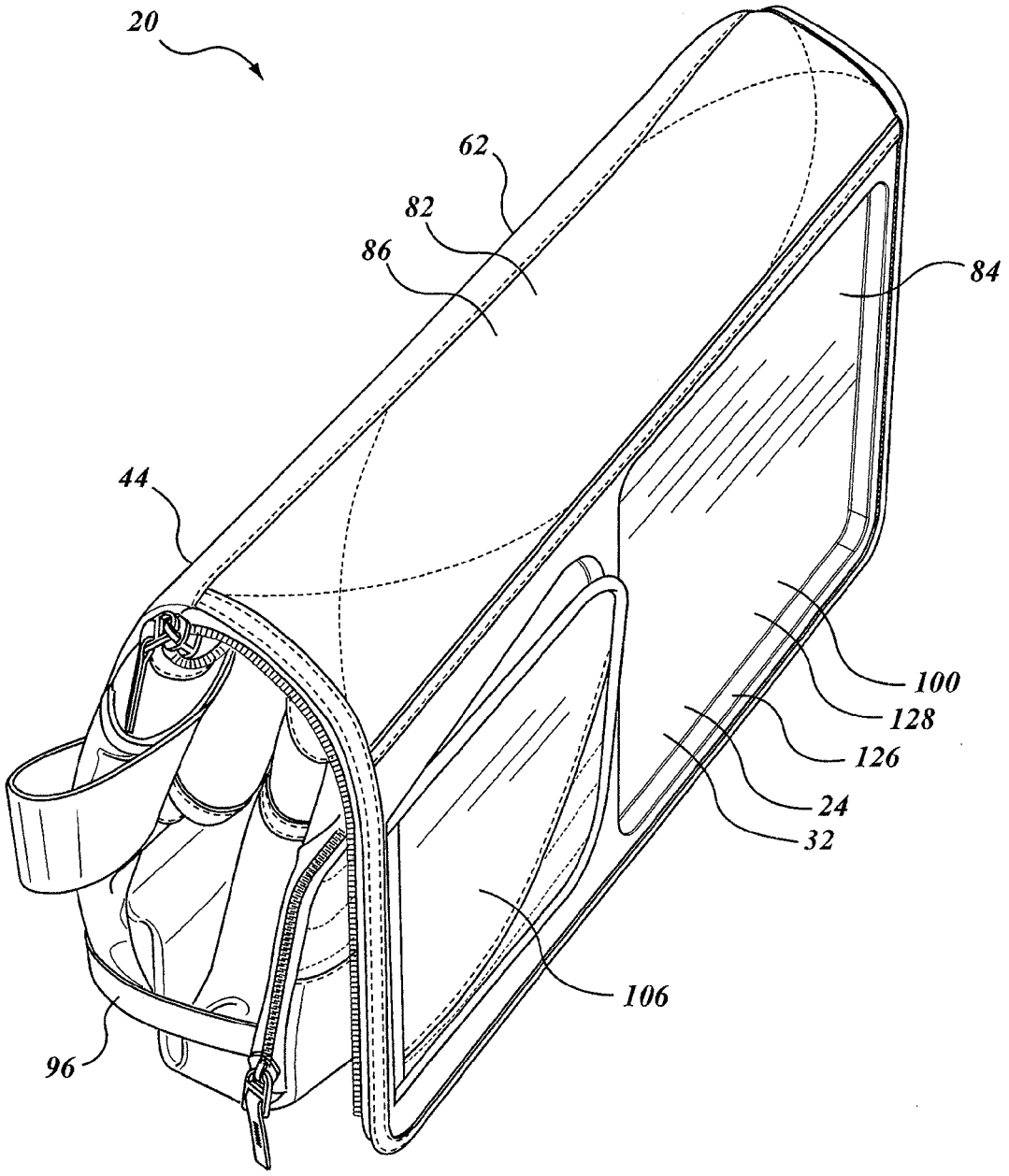
FIG. 2*a* shows a perspective view taken from in front, above, and to the right, the container assembly of FIG. 1*a* in a collapsed, or folded, condition.
Figure 2B:
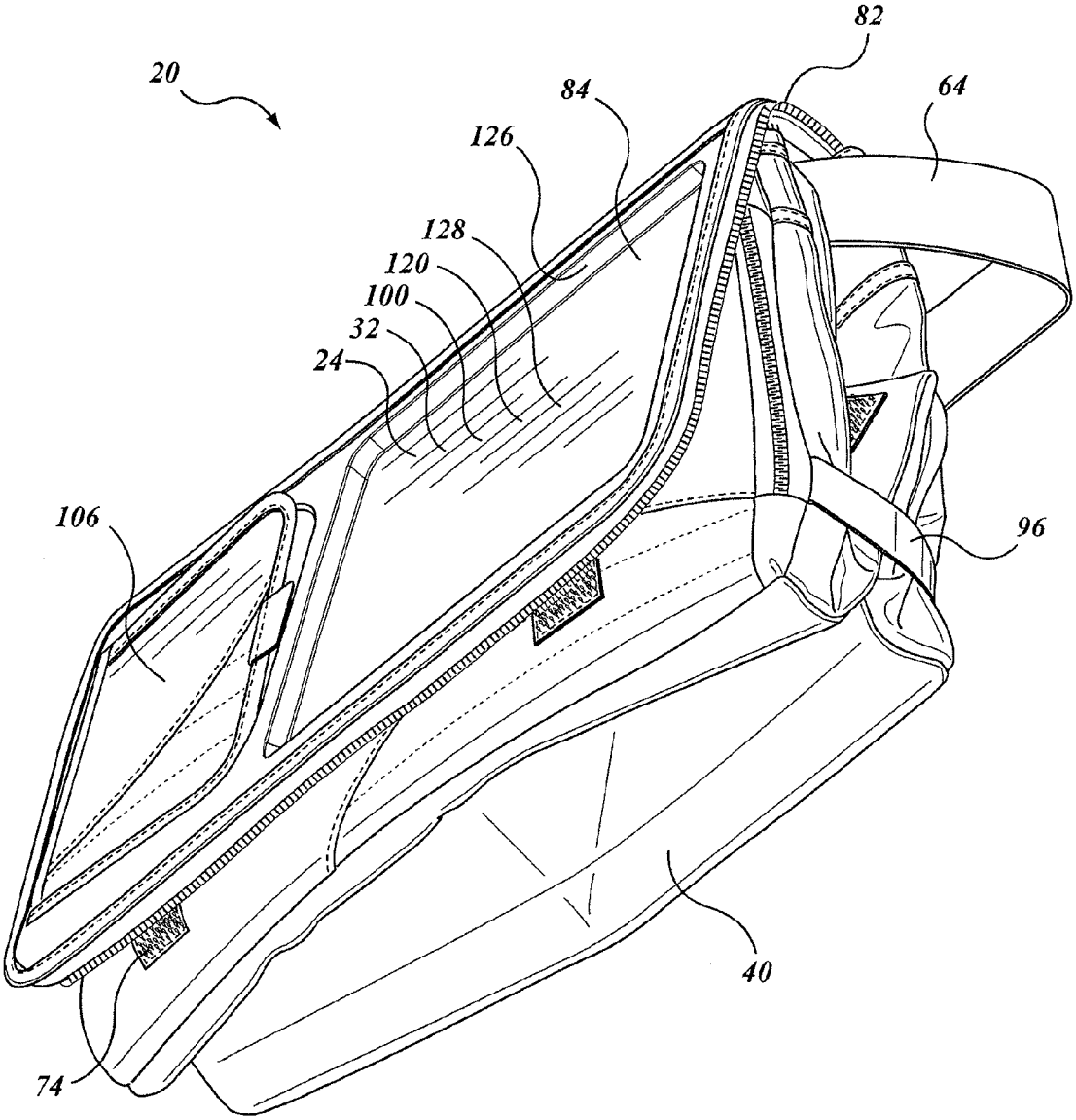
FIG. 2*b* shows the folded container assembly of FIG. 2*a* in a perspective view taken from below, in front, and to the left.
Figure 2C:
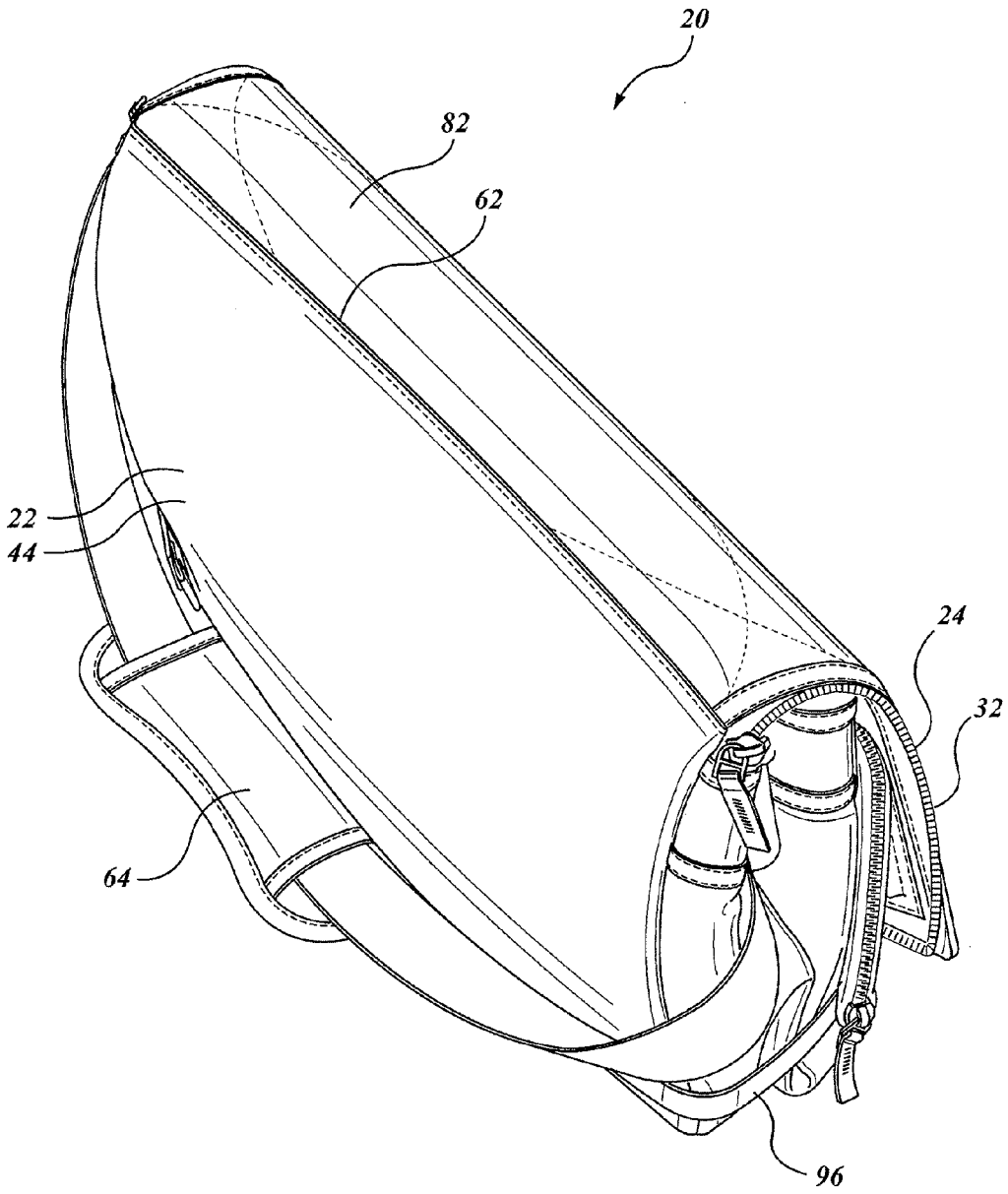
FIG. 2*c* shows the folded container assembly of FIG. 2*a* in a perspective view taken from above, behind, and to the right on the opposite diagonal to FIG. 2*b;*
Figure 2D:
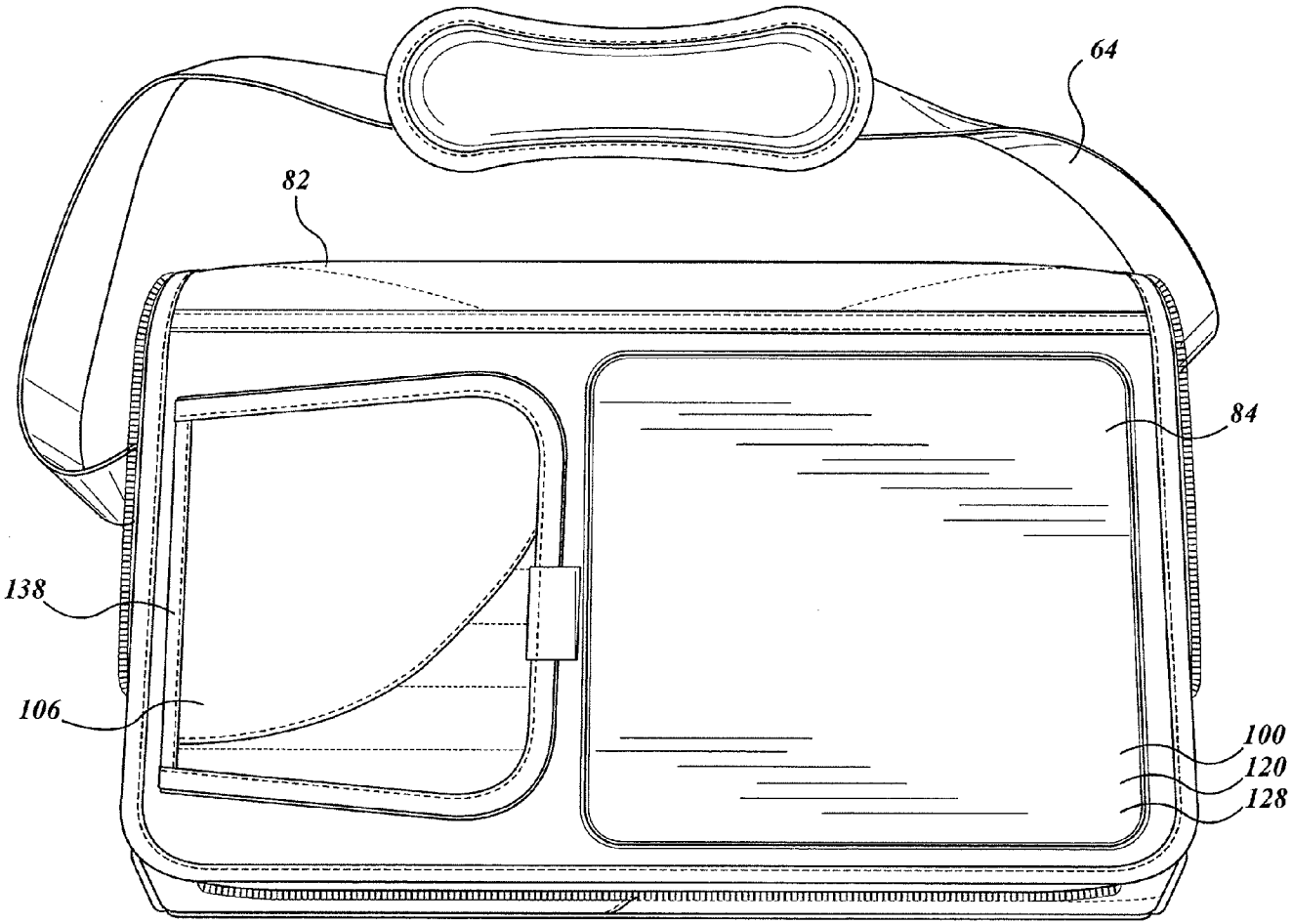
FIG. 2*d* is a front view of the container assembly of FIG. 2*a;*
Figure 2E:
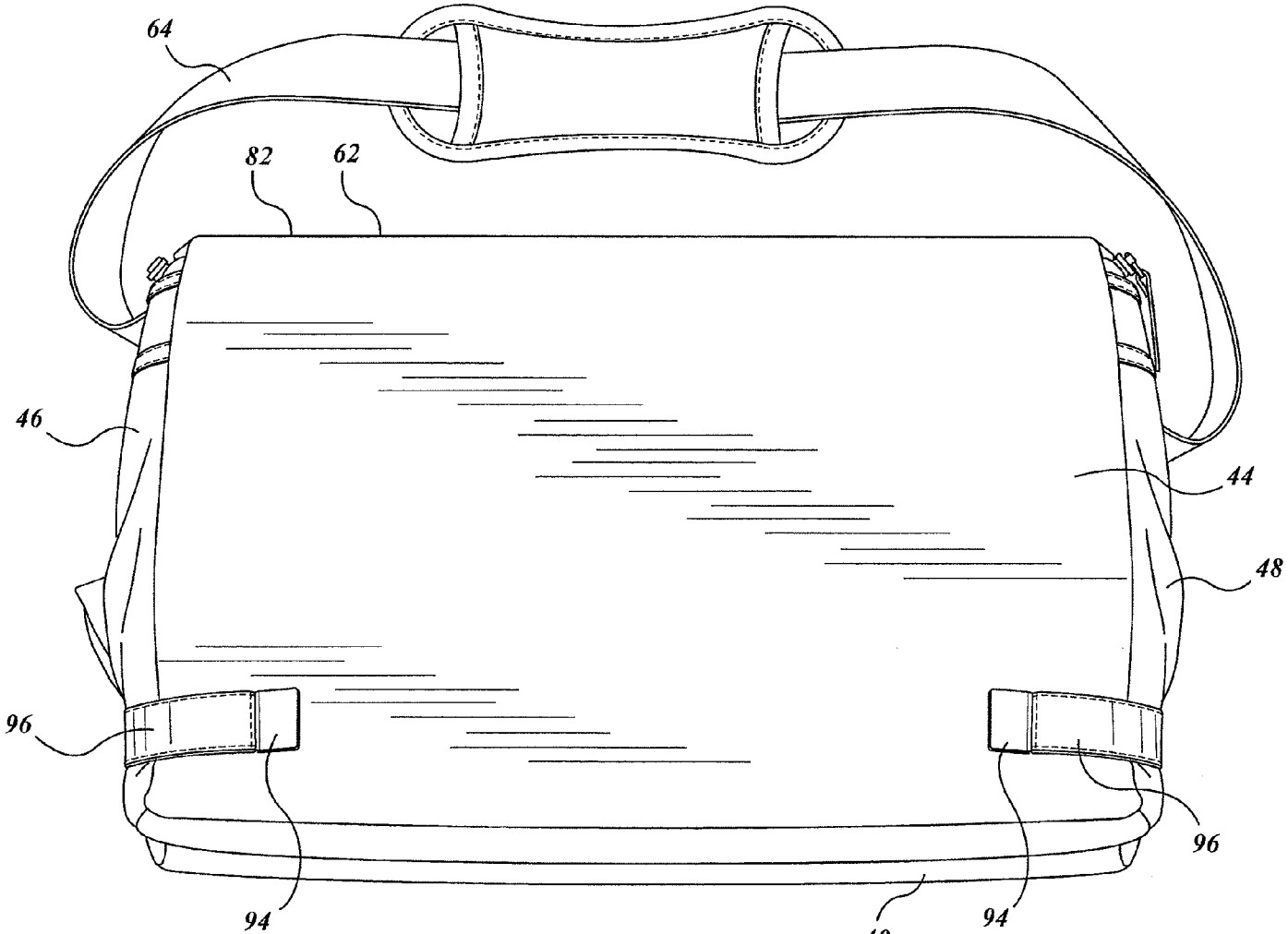
FIG. 2*e* is a rear view of the container assembly of FIG. 2*a;*
Figure 2F:
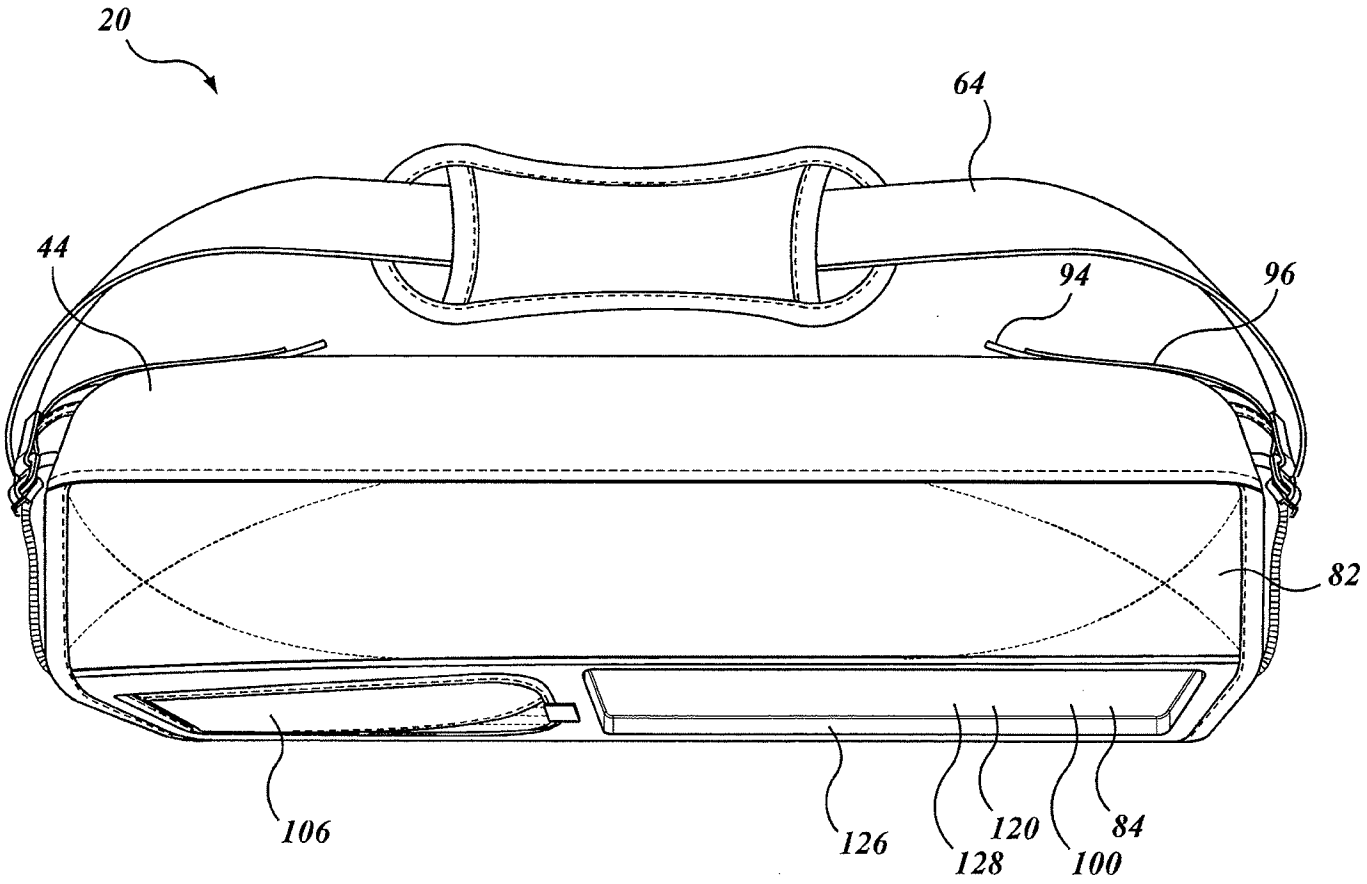
FIG. 2*f* shows a top view of the container assembly of FIG. 2*a;*
Figure 2G:
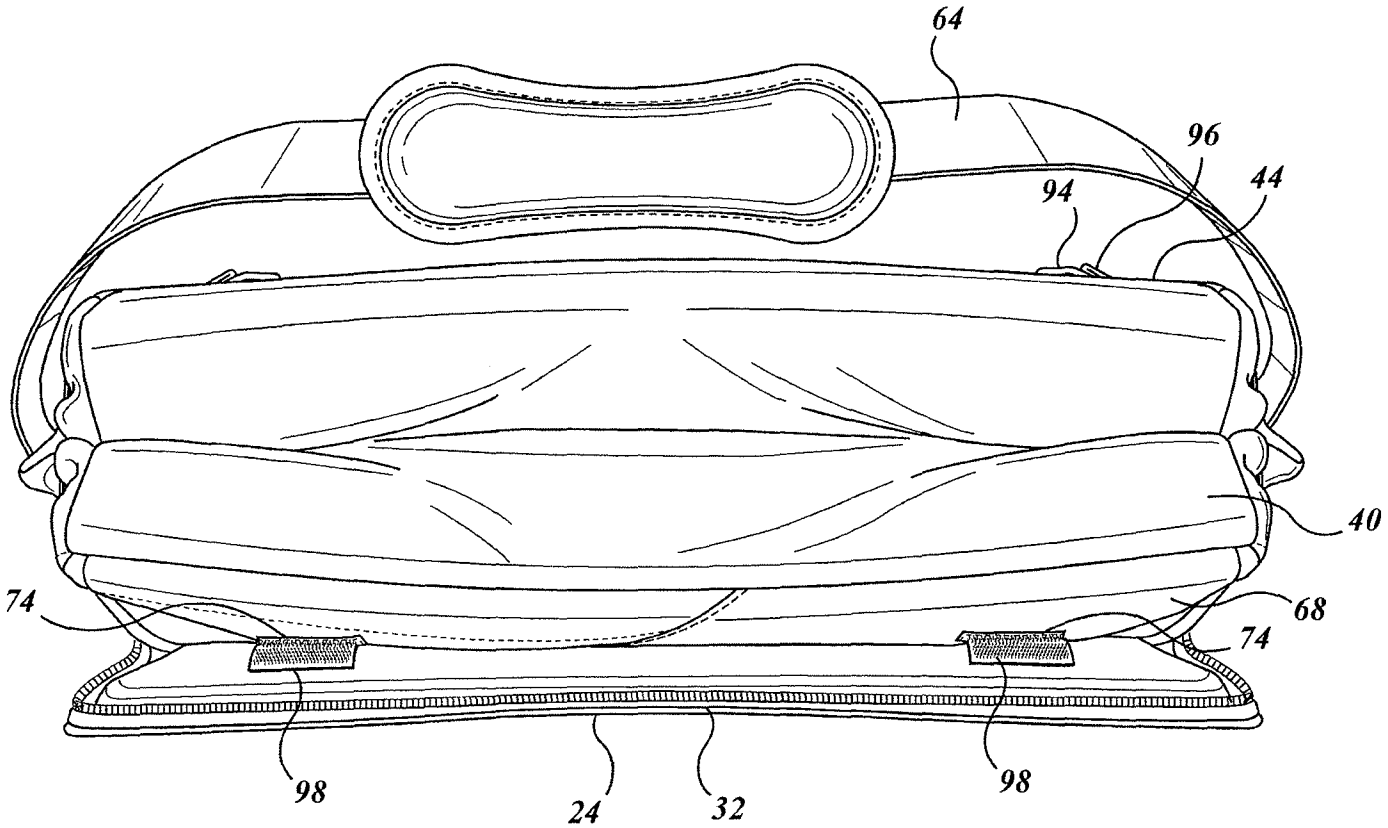
FIG. 2*g* shows a bottom view of the container of FIG. 2*a;*
Figure 2H:
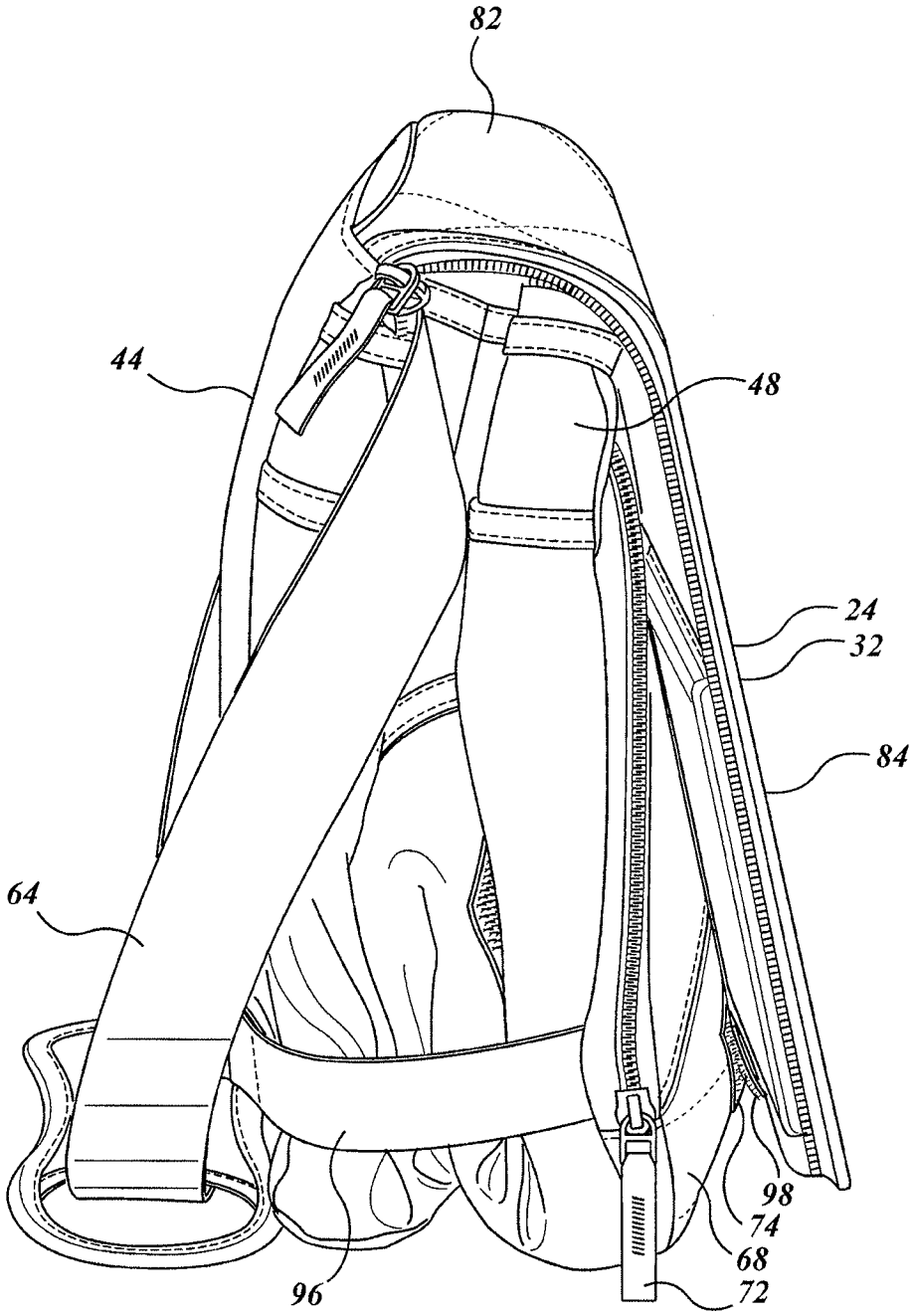
FIG. 2*h* is a left hand view of the container assembly of FIG. 2*a;*
Figure 2I:
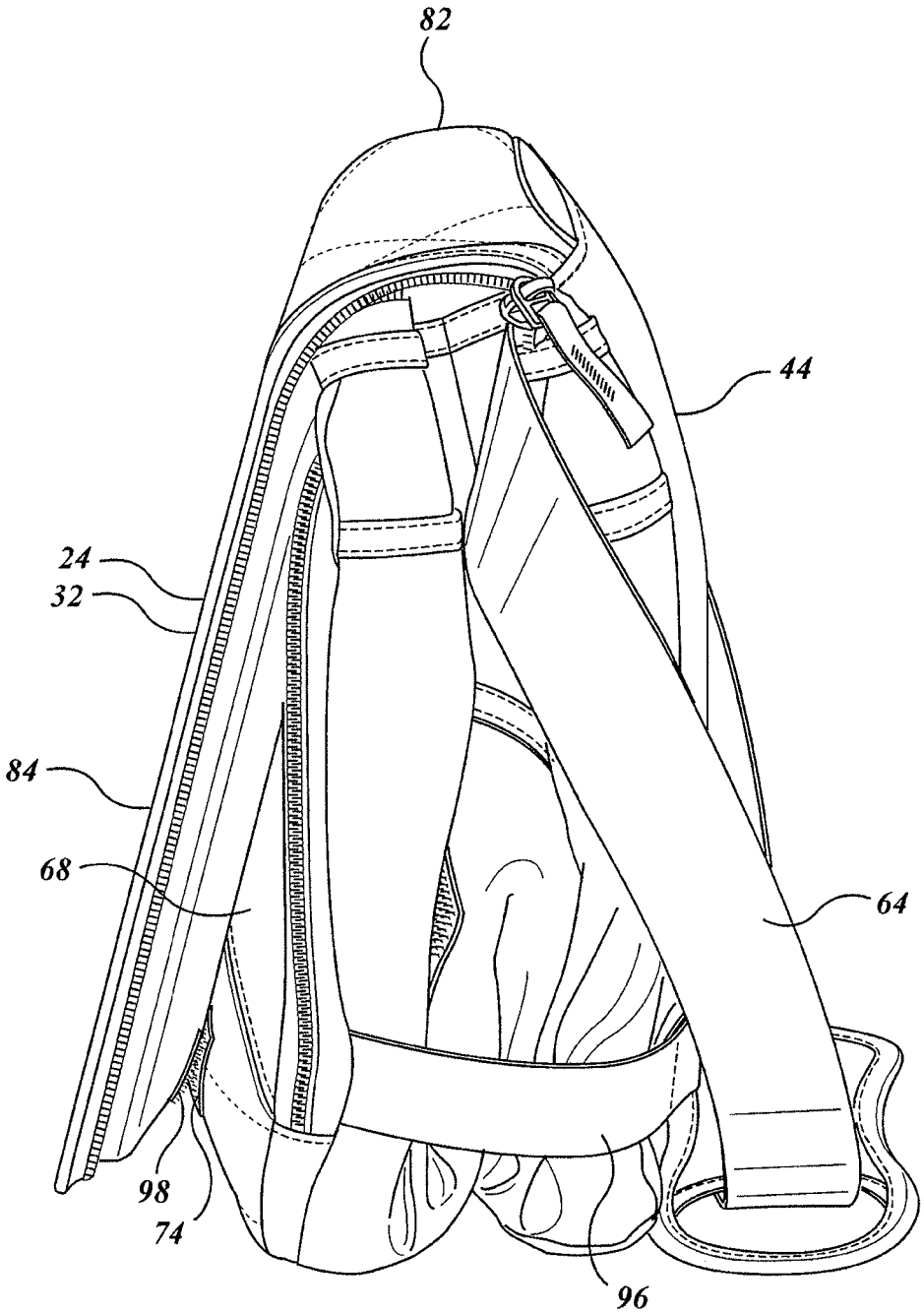
FIG. 2*i* is a right hand view of the container assembly of FIG. 2*a;*

Similarly, in some embodiments, as in the collapsible embodiment noted above, main body 22 may have a height in the z-direction, that height being the distance from the bottom surface of bottom panel 40 to rim 50, and being substantially the same (if not identical to) the z-direction extent of front panel 42, such that it may be identified as $h_{42}$. In the embodiment of FIG. 1*a*, the length of second portion 84 may be less than or equal to the height of front panel 42, that is, $L_{82}<h_{42}$, such that in the collapsed condition second portion 84 may lie against, or generally adjacent to, from panel 44 in a compact, folded position, without interfering with or obstructing, the ability of body 22 more generally to be folded.

Second portion 84 may include a first region, 102, and a second region 104. First region 102 may include table top 110. Second region 104 may include a second, or secondary, or auxiliary, or alternate, closure member (or closure member assembly) 106 that provides access to chamber 28 through a second, or secondary, opening 108.

Substantially rigid member 100 is, or underlies, or defines first region 102, including table top 110. In some embodiments it may be that substantially rigid member 100 is of such an extent that a portion thereof also underlies, or extends about, or defines, second region 104, although this need not necessarily be so. In some embodiment the auxiliary closure member need not necessarily be reinforced with a rigid member, but may be formed in a soft-sided, unreinforced wall panel structure, instead.

Member 100 may have a generally rectangular periphery 112, which lies, generally in a first x-y plane $P_{112}$. Periphery 112 may include a rearward, or proximal, margin 113 closest to hinge 62, and adjoining first portion 82 of lid 32; and a distal margin 114 opposite thereto most distant from hinge 62. Margins 113 and 114 may run generally parallel to hinge 62 in the x-direction. Periphery 112 may also include a left hand margin 115 and a right hand margin 116, those left and right hand margins being space apart and opposed. When the cooler is expanded and lid 32 is closes, margins 115 and 116 may run in the y-direction.

It may be that margin 113 adjoins first portion 82, or, in embodiments in which there is no first portion 82, then adjoining hinge 62. It may also be that margin 114 extends along the distal-most edge of lid 32 farthest from hinge 62 such that member extends the full length of second portion 84 in the radial direction relative to hinge 62, which may also be expressed as the full length of second portion 84 in the y-direction when lid 32 is closed. In such instance, when lid 32 is closed, and the main closure securement, be it a zipper or other tracked fastener is in place in a mating, closed, configuration, margin 114 may be adjacent to, and to run along part or all of, upper margin 52 of front panel 42.

Similarly, when lid 32 is closed, it may be that left hand margin 115 runs along the left-most edge of lid 32, and, for part or all of its run in the y-direction it may run along upper margin 56 of left hand end panel 46, and right hand margin 116 may run along the right-most edge of lid 32, and, for part or all of its run in the y-direction it may run along upper margin 58 or right hand end panel 48. Where margins 115 and 116 run along the left-most and right-most margins of lid, then member 100 spans the full width of lid 32, or, expressed differently, member 100 extends the full length of lid 32 in the x-direction.

Where the margins of member 100 run along the edges of lid 32, overlying the upper margins of panels 42, 46 and 48, to such extent as may be, member 100 may tend locally to stiffen those upper margins and fix their position. Where the margins of member 100 run along any two of them, or are mated to the distal margin of reinforcement member 88, reinforcement member 100 may tend to stabilise that upper margin, to stabilise the relative positions of the upper margins so linked, and to function as a substantially rigid shear panel between those wall panels, thereby tending to maintain (if not to establish) the side wall panels in rectangular relation relative to each other, and to maintain the generally rectangular plan form of container assembly 20 in the expanded position more generally. When viewed on a projection in the z-direction, (with lid 32 closed on rim 50), member 100 may have the same, or substantially the same, extent, or footprint, as second portion 84, e.g., in the lengthwise and widthwise directions. In other embodiments, table top 100 may be smaller than second portion 84.

Periphery 112 may have a profiled of recessed leg or toe 118 at the outermost extremity. The downward step or recess, indicated at 108, may be such that it provides a seat for fabric materials that may be sewn or otherwise fastened to it, whereby the fabric may be flush.

Substantially rigid member 100 presents a work surface 120 upon which objects, such as a can, a bottle, or a glass, cup, or tumbler, may be placed. Work surface 112 is oriented to face away from chamber 28, and may present a cutting board surface upon which an apple, a lemon or a lime (or other fruit, or vegetable, or cheese), or a sandwich may be sliced. It may be made of or surfaced with, any suitable rigid material, even such materials as wood, metal or ceramic. It may most typically be made of a formed plastic member, such as may be made from a high density plastic such as polyurethane sheet, nylon sheet, UHMW plastics, and so on. The sheet stock from which table top 100 is moulded or formed may have a nominal thickness in the range of perhaps 1/32" to 1/8", but may typically be if the order of 1/16" to 3/32" thick.

Considering the embodiment illustrated in FIGS. 4*a* to 4*d*, first region 102 and second region 104 lie to either side of an intermediate member 122, which, in the embodiment shown, runs in the y-direction across member 100 between margin 113 and margin 114.

First region 102 has a depressed central portion, or central web 124 that is surrounded at its various edges by margins 113, 114, 115 and intermediate member 122. Central portion or web 124 may be substantially flat and planar, and may lie in a plane $P_{124}$ that is substantially parallel to, and offset from, plane $P_{112}$. In each case depressed central portion 124 is adjoined by a web or wall 126 that stands predominantly in the z-direction joining central portion or web 124 to margins 113, 114, 115 and member 122, whereby the effect is to define flanges 130 around a flat central portion. The upper, or outwardly facing surface 128 of central web 124 defines the work surface of the table top, or it may be faced with a surface member or surface treatment, as may be appropriate, e.g., such as form making a cutting-board surface, or for having a no-slip roughened surface to discourage sliding. The peripheral flange also defined a retainer, or peripheral wall, that may tend to discourage the sliding of objects there-off in the event that cooler assembly 20 is placed on a surface that it not precisely level, and the may tend to some extent to retain spills until they can be cleaned up.

It is not necessary that table top 120 defined by surface 128 be square or rectangular. It could, for example, be circular, or elliptic, or oblong, as may be. A square or rectangular surface of substantial area may be desirable, where the maximum y-direction width corresponds to $h_{42}$, or roughly so. The x-direction extent may be comparable, and in some embodiments may be greater, even to the extent of the x-dimension length of lid 32.

Second region 104 may also have a depressed potion 132, which itself may be substantially planar in an x-y plane $P_{132}$ offset from plane $P_{112}$ by some distance in the z-direction. This offset distance may be less than, equal to or greater than the offset distance of plane $P_{124}$ from plane $P_{112}$. Depressed portion 132 is surrounded by part or all of margins 113, 114, 116 and intermediate member 122, such that, again, the effect is to form a continuous, flanged periphery. (In the embodiment illustrated, member 122 effectively becomes a channel-section or rib defining a divider between regions 102 and 104.) Web 132 has a central cut-out, or opening 134. In plan-view, the profile of web 132 may be square, or rectangular, as may be, or may have the shape shown, in which one side (at the staff) is straight and relatively short, and the distant (or distaff) side is relatively longer, with the remaining two edges following a widening or splaying shape, so that the overall outline is that of a trapezoid, with two sharp corners and two corners formed on relatively large radii. As assembled, a closure member 136 is mounted with a fixed edge along one side (the short side), defining a hinge 138. Closure member may have the form of a flap movable between open and closed positions to govern access to chamber 28 through opening 108. A zipperless securement, such as mating hook-and-eye fabric fastening strips 140, 142 may be provided to permit the user to operate closure member 136 with one hand. Although it is not necessary, it may be convenient for the distaff (or distal) edge of closure member 106 to be oriented toward, or amidst, table top 120, such that when closure member 106 is open, the flap hangs over the outboard edge of lid 32, tending thereby not to impede the convenient removal of objects from chamber 28, and the placement of those objects, without obstruction, on table top 120. In some embodiments, the underside, or inside, of first portion 82 of lid 32 may be lined with an insulating layer 144, and the inner skin of layer 144 may be a reflective skin. Similarly, the underside of portion 84 may have an insulation layer 146, which may have a reflective inner skin. The underside of the flap of auxiliary closure member 106 may likewise have an insulation layer, or blanket, as at 148.

Figure 5A:
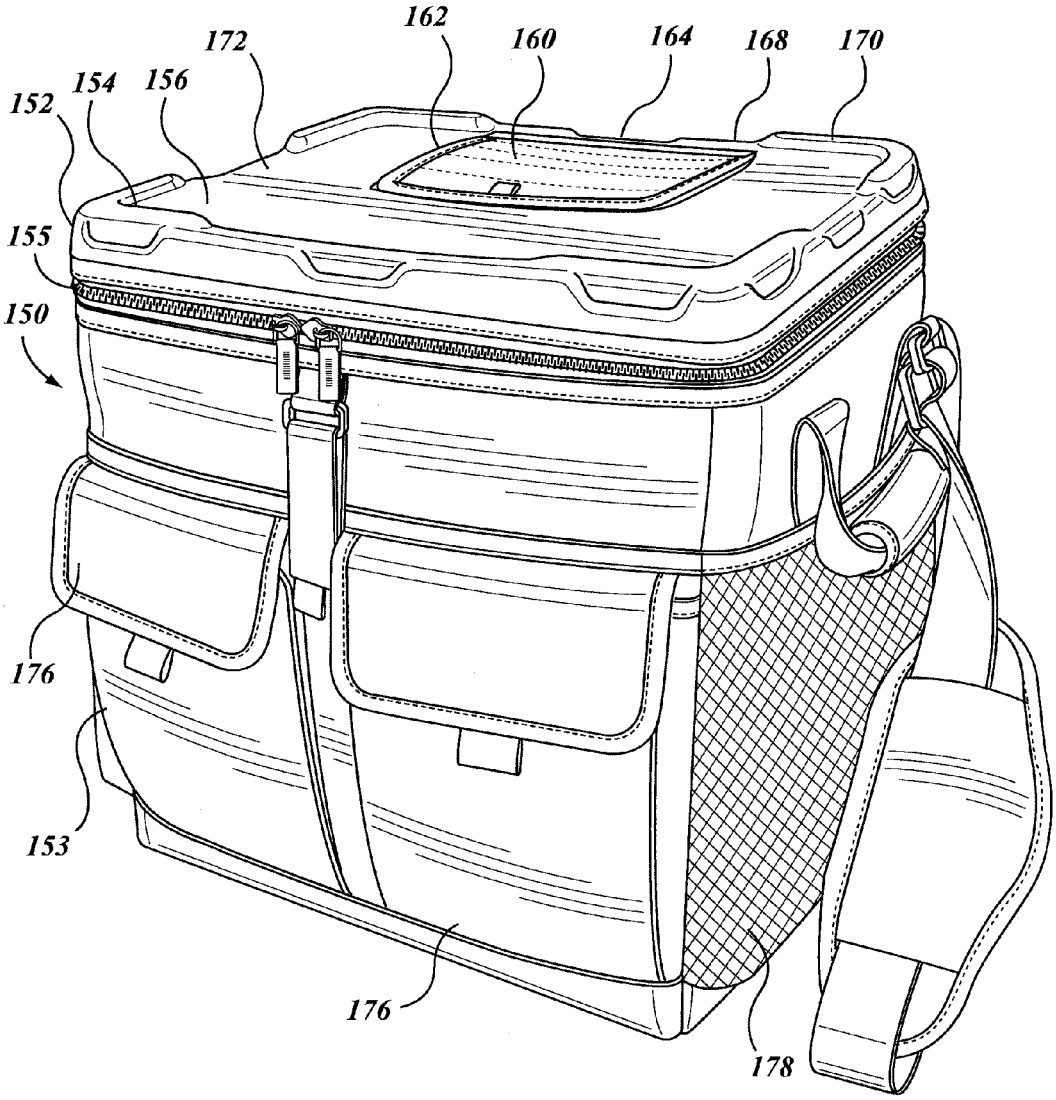
FIG. 5*a* is a perspective view of an alternate arrangement of soft-sided insulated container assembly to that of FIG. 1*a* shown in an expanded condition.
Figure 5B:
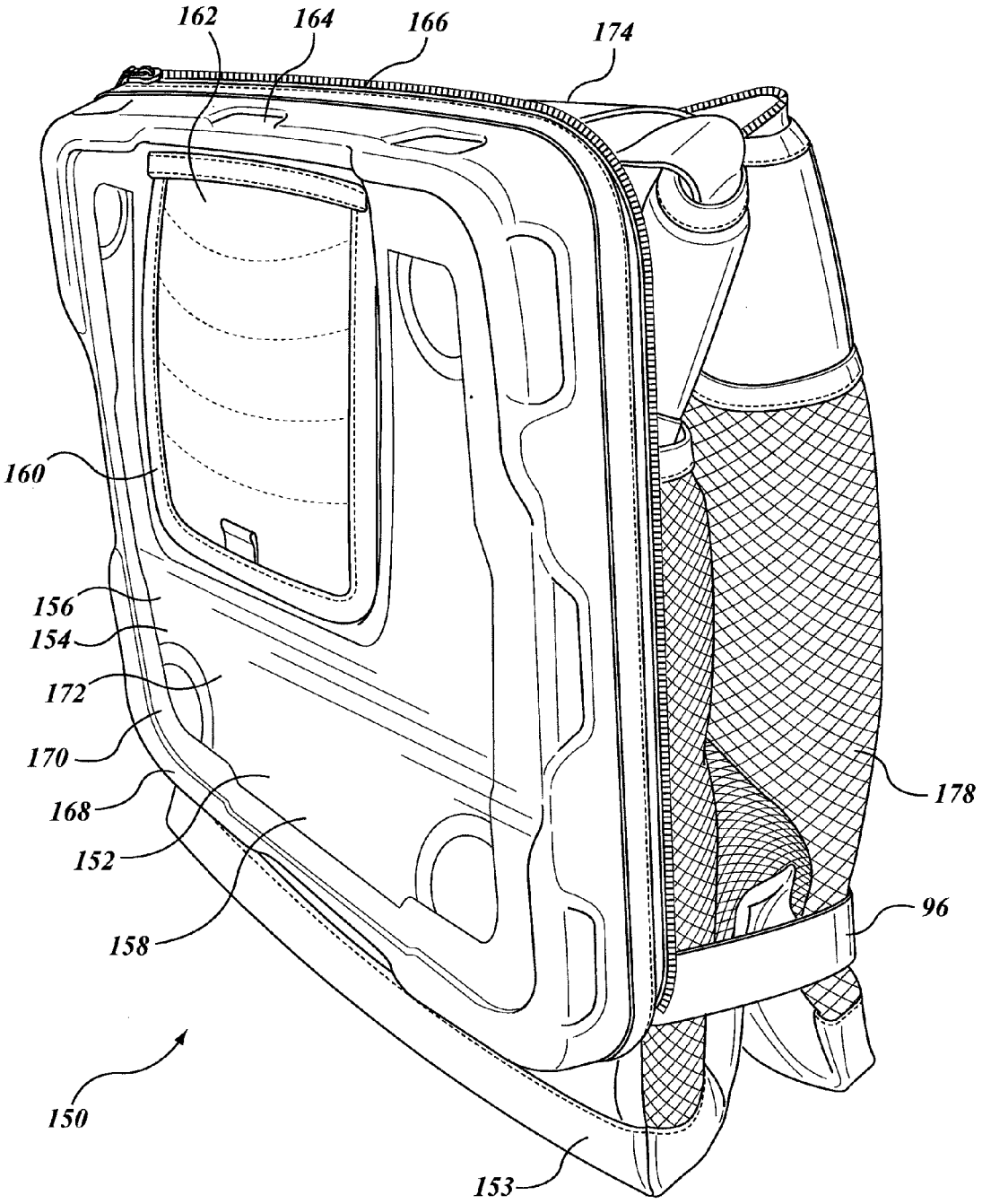
FIG. 5*b* is a perspective view of the soft-sided cooler assembly of FIG. 5*a* in a collapsed, retracted, or storage position or configuration.
Figure 5C:
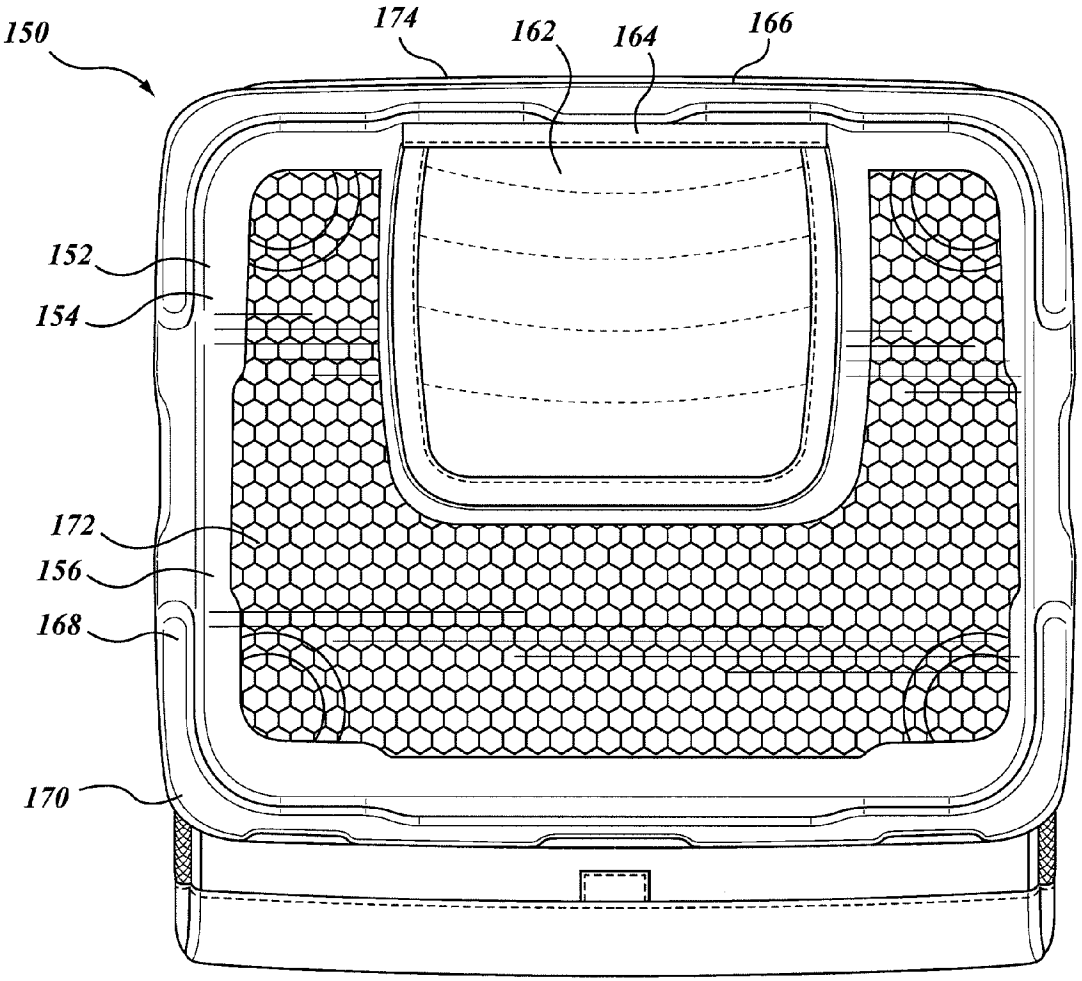
FIG. 5*c* is an end, view of the soft-sided insulated container assembly of FIG. 5*b;*

In the embodiment of FIGS. 1*a* to 1*h*, the first and second regions of distal portion 84 are located side-by-side in a left-hand and right-hand orientation, with the opening of auxiliary closure member 106 facing toward table top 110. Alternate embodiments are possible. For example, closure member 106 could face the front of the unit, i.e., toward margin 114, or such other direction as may be appropriate. The arrangement need not be left-hand-right hand. For example, in the embodiment of FIGS. 5*a*-5*d*, soft-sided insulated container assembly 150 has a top wall defining a lid portion, or lid, 152 that includes a rigid member 154 that is substantially co-extensive with lid portion 152 (and of the footprint of the base of assembly 150 more generally. Rigid member 154 may include a first portion 156 defining a work surface, or table top, 158, and a second portion 160 that defines a zipperless auxiliary closure member 162. Closure member 162 has an hinged margin 164 that is located adjacent to the hinged margin 166 of lid portion 152 more generally. Closure member 162 opens toward table top 158, i.e., toward the center or centroid thereof, but in this instance is mounted along the rear margin of lid 152, and is in an intermediate position in the left-to-right width direction. That position may be on the centerline of the unit. Rigid member 154 may be a moulding of relatively deep section, and may include peripheral retaining features such as a continuous peripheral lip 168 or raised corners 170, or both. As seen most clearly in FIG. 5*c*, working surface 172 of table top portion, or work surface, 158 is a textured surface with non-slip features.

As shown in the illustrations, the work surface 158 of lid 152 may span the entire width of the surface in the x-direction, and may also span the entire depth of the surface from the rear edge to the front edge in the y-direction (when the assembly is in the expanded condition). As above, it may also form a rigid frame to maintain the general box shape of the assembly when deployed. In this configuration, the lower margin of formed rigid member 154 may have a securement, such as a tracked fastener 155 (e.g., a zipper) by which it is joined to the lower portion, or body, 153 of assembly 150 more generally when the assembly is in the expanded position and lid 152 is in the closed position relative thereto. When tracked fastener 155 is released, lid 152 may be moved to an open position, analogous to that shown in for assembly 20 in FIG. 3*c*, thereby permitting, for example, loading of container assembly 152 generally.

When assembly 150 is moved to the collapsed position or condition, an internal flexible hinge, or web member, 174, which may be made of Nylon™ or other cloth, or of an elasticized, or somewhat elasticized, or "stretchy", material, in whole or in part, permits the rear margin of lid 152 to separate from the upper margin of the rear wall of body 153, the extended length of member 174 permitting lid 152 to be folded over the front of the unit as collapsed, with member 174 being curved over the collapsed sidewalls in a manner similar to the curvature of portion 82 of assembly 20 in the collapsed condition. When assembly 150 is in the expanded position, member 174 hangs inside the main internal enclosure of assembly 150, analogous to chamber 28 of assembly 20.

Figure 5D:
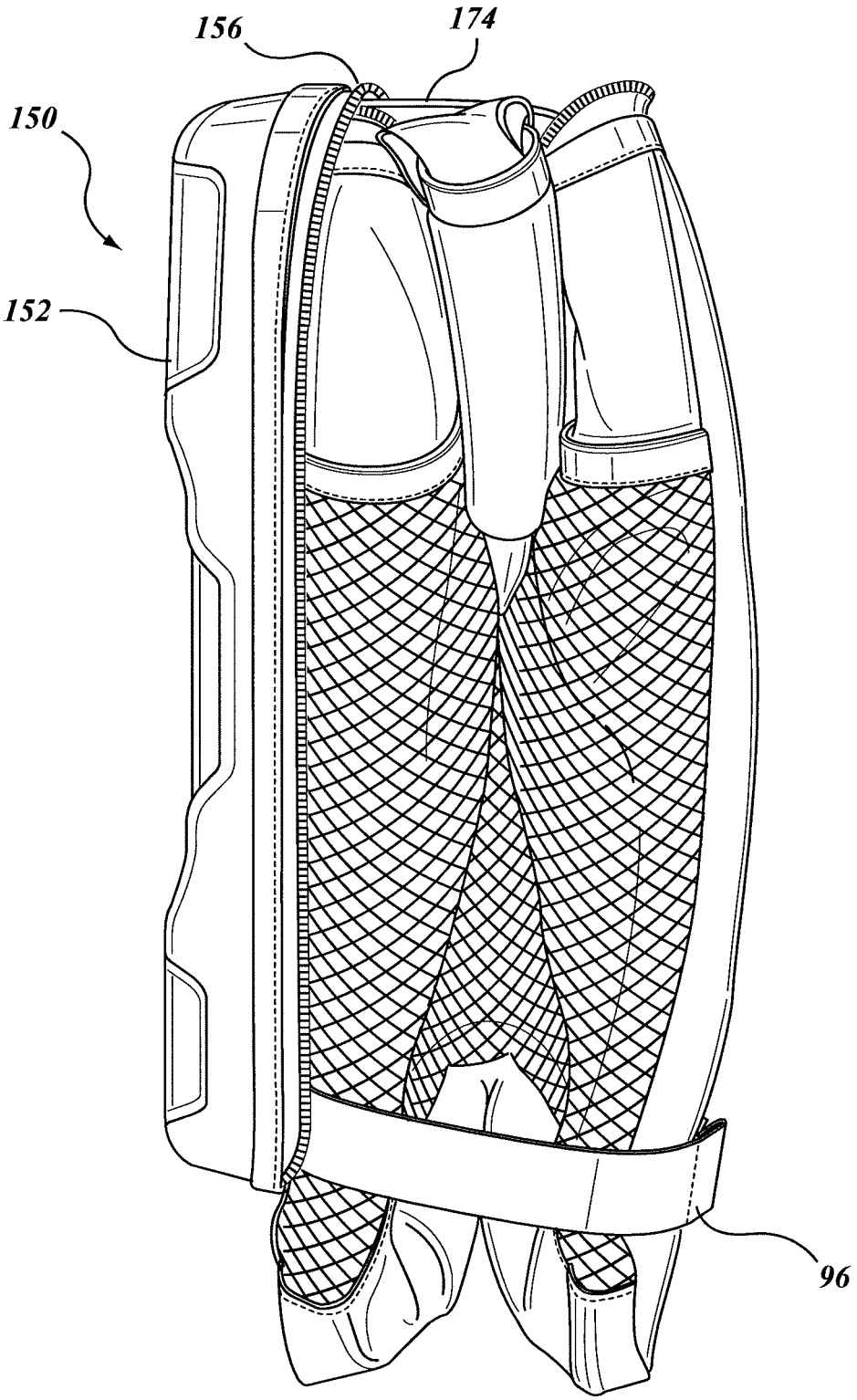
FIG. 5*d* is a front view of the soft-sided container assembly of FIG. 5*b;*
Figure 5E:
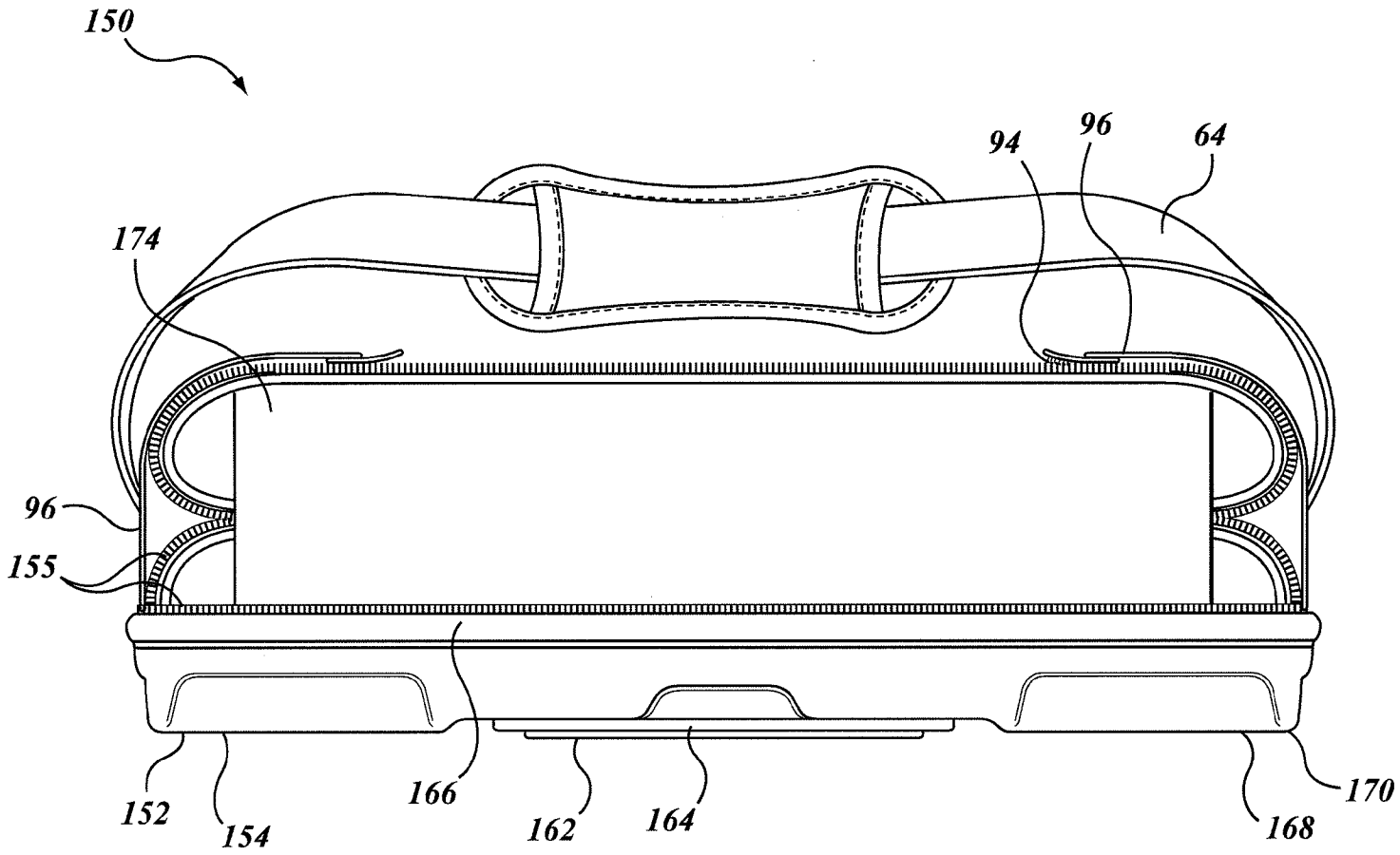
FIG. 5*e* is a top view of the soft-sided insulated container assembly of FIG. 5*b;*

The secondary members of the structure of assembly 150 may differ from assembly 20, as indicated by external pockets 176 and netting 178. In other respects, the construction of insulated container assembly 150 is substantially the same as container assembly 20. The insulated wall structure construction is the same, and assembly 150 may include a removable liner, also as described above. Assembly 150 is a collapsible soft-sided insulated container assembly, as shown in FIG. 5*d*. As with container assembly 20, the substantially rigid member is of similar length and width to the front face of container assembly 150 more generally, such that when collapsed as in FIG. 5*d*, the collapsed container sections nest against, and have substantially the same projected profile as, rigid member 154.

In another alternate embodiment, FIGS. 6*a*-6*h* show a soft-sided insulated container assembly 180. It has a first portion 182 and a second portion 184. First portion 182 defines the lower portion of the container body, and may be taken as being substantially the same in construction as main body 22 of container assembly 20, with the exception of front auxiliary container compartments 183 and 185 in place of secondary wall panel assembly 68.

Second portion 184 may be taken as being the same as lid portion 32 of container assembly 20, having a first portion 186 substantially the same as first portion 82, differing therefrom to the extent that second portion 188 of lid portion 184 has an extendible table top structure or assembly, identified as substantially rigid assembly 190 in place of substantially rigid member 100. To that extent the description of lid portion 32 is not repeated.

In place of substantially rigid member 100, assembly 190 has a three piece sandwich assembly that includes a movable member as described hereinbelow. The first piece of the three piece assembly is a base member or base frame, identified as first substantially rigid member 192, which has the same arrangement of margins and footprint as member 100, and is sewn to the underlying fabric and insulation elements of second portion 184 in the same manner. Rigid member 192 has a substantially planar central web portion 194 which spans second portion 188 in the x and y directions, and which is bounded on three sides of its periphery by out-of-plane reinforcement members, or flanges, identified as first (or left hand), second (or front), and third (or right hand) flanges 196, 197, and 198 respectively that stand in the z direction out of the x-y plane of central web portion 194. These reinforcements may also function as retainers or retaining walls for guiding or inhibiting motion. While out-of-plane reinforcements may have many shapes, in the embodiment shown items 196, 197 and 198 have the form of top-hat, or channel, sections moulded into member 192. The outer leg 199 of the top hat section may be co-planar (or substantially co-planar) with central web portion 194, though it may be of thinner section. The resultant U-shaped wall (as seen from above)

terminates at its rearward margin at left and right hand, turned-in abutments, or stops, indicated as 200, 202. Other than stops 200, 202, the rearward margin of member 192 may be substantially clear and planar.

Rigid member 192 has a depressed, or stepped-down flanged portion 204 which has defined therein an auxiliary opening 206. An auxiliary or secondary closure member, 210 may be mounted to flanged portion 204 in substantially the same manner as auxiliary closure member 136 is mounted to depressed portion 132. The clear, unimpeded, flat central portion of substantially rigid member 192, indicated as 208, defines a first region 212 of member 192, and depressed flanged portion 204 defines a second region 214 of member 190. First region, 212, when exposed defines a first work surface 216 upon which objects may be placed.

Assembly 190 also includes a second rigid member, 220. Member 220 has a substantially planar central web portion 222 bounded on three sides of its periphery by out-of-plane reinforcement members, or flanges, identified as first (or left hand), second (or rear), and third (or right hand) flanges 224, 225, and 226 respectively that form a continuous three-sided wall. The rearward reinforcement section may be asymmetric, having a longer outboard depending leg. The other reinforcements may also have the form of channel sections, and may function as retainers or retaining walls. While out-of-plane reinforcements may have many shapes, in the embodiment shown items 224, 225 and 226 have the form of a channel, sections moulded into the respective peripheral edges of member 220. A further flange, in the form of a channel section 230, may be formed along the front margin of web portion 222 and define a reinforced edge, or flange thereof. At the front-ward corners of the left and right hand margins are shown outwardly protruding abutments, or stops 232, 234 respectively. Second member 220, or the central web portion thereof may be made of a see-through, i.e., transparent material. The central web portion of second member 220 defines another work surface 228. Work surface 228 is a movable work surface that may translate between a first, retracted or storage position entirely or predominantly overlying first member 192, and a second, extended or deployed position or condition less predominantly overlying member 192, and in which second position member 192 may be predominantly or entirely exposed, and member 220, or a substantial portion thereof may be moved to a cantilevered position overhanging portion 182, and having a free edge extending therebeyond. Work surface 228 may be a cutting-board surface, or a textured non-slip surface, or a plain smooth surface, as may be, that working surface being bounded by a retainer in each direction.

Assembly 190 further includes a third member 240, which is a retainer, or cap plate, or closing member which mounts to the backs of the top hat sections of the three-sided U-shaped wall of member 192, entrapping member 220 vertically in a sandwich arrangement. Third member 240 may have the general shape of a picture-frame, or bezel, or peripheral strip that extends about the perimeter of second region 188, with an open central region 248 that may be predominantly rectangular, and that exposes the upper surface of the underlying member, be it first member 192 or second member 220, through that generally rectangular opening (it need not be rectangular, but could be some other appropriate shape). The relationship of second member 220 to first member 190 and third member 240 is such that there is a single degree of freedom of motion, in this case translation in the y-direction parallel to the planes of the respective central webs of both first member 190 and second member 220. The mutual engagement or co-operation of the respective left and right hand side flanges of first member 190 and second member 210 define guides for each other and for their respective stops, second member 210 being nested within the side flanges of first member 190. Motion in the forward direction is limited by engagement of the leading edge of flange 230 of member 220 against the rear or inward wall of the front flange 197 of member 192, and sliding motion in the opposite direction being bounded, or limited, or arrested, by the mutual engagement of the stops 200 and 202 of stationary member 192 with stops 232, 234 of movable member 220.

Member 240 may fit closely upon and have substantially the same footprint when seem from above as the U-shaped three sided reinforcement wall of item 190, the width of member 240 inwardly along the left and right hand edges being at least partially to overlap, and therefore capture in the vertical direction, the left and right hand side flanges of member 220, such that the cooperative relationship of the left and right hand side portions 236, 238 of member 240 and the vertical space of the top hat sections of the side reinforcements of member 190 function as a guideway, or pathway, or track, for the slidingly mutually engaged side edge reinforcements of member 220. On its rearward margin, or run, or edge 242 member 240 has a forwardly deviating relief, or dog-leg, as at 244, which co-operates with a corresponding rearwardly deviating dog-leg portion 246 in the rearward edge of member 220 to give access to the handle thereby defined by portion 246 of rear margin flange 226 of member 224 exposed when member 220 is in the closed or retracted position shown in FIG. 6*e*. When in the closed position, member 220 covers, and conceals, auxiliary closure member 210. When access is desired, member 220 is moved to its extended position as shown in FIG. 6*d*.

Figure 6A:
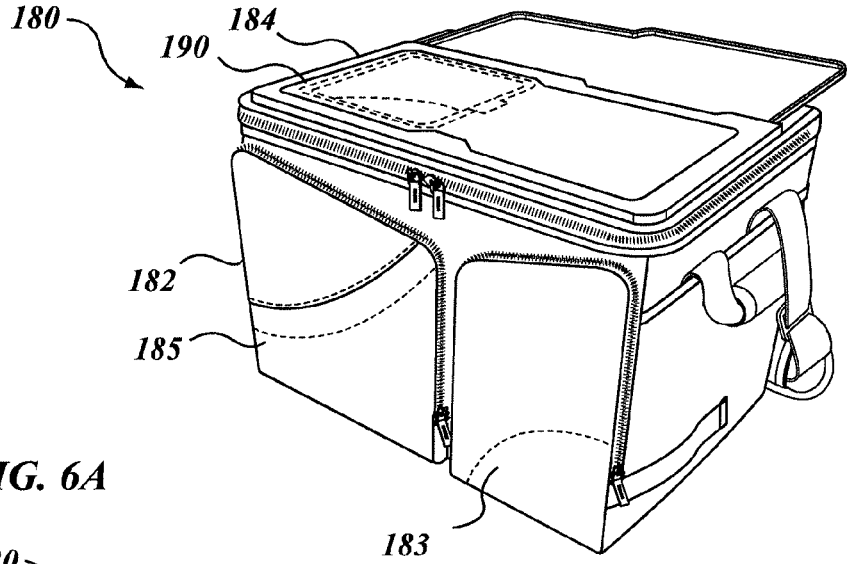
FIG. 6*a* shows a perspective view of an alternate soft-sided container assembly to that of FIG. 1*a* with a movable work surface member in an extended position.
Figure 6B:
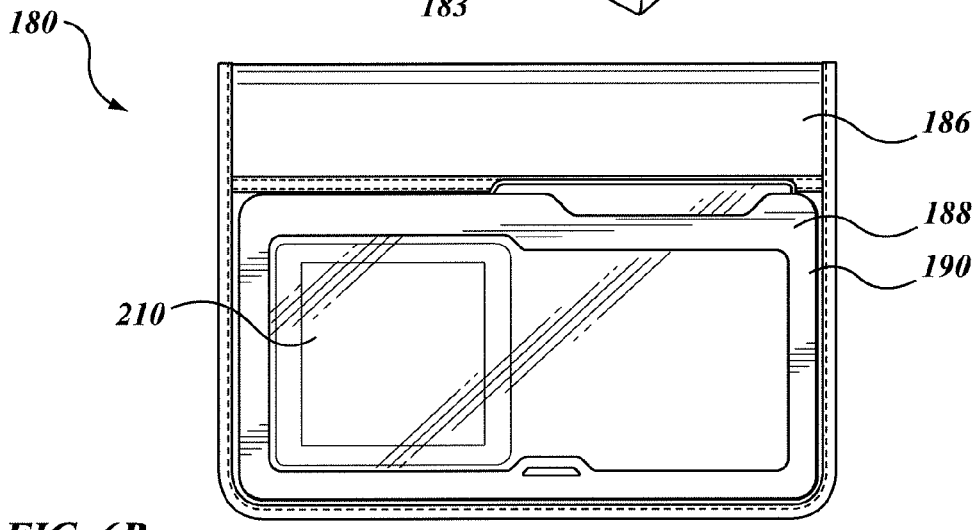
FIG. 6*b* is a top view of the container assembly of FIG. 6*a* with the work surface in a stored or retracted position.
Figure 6C:
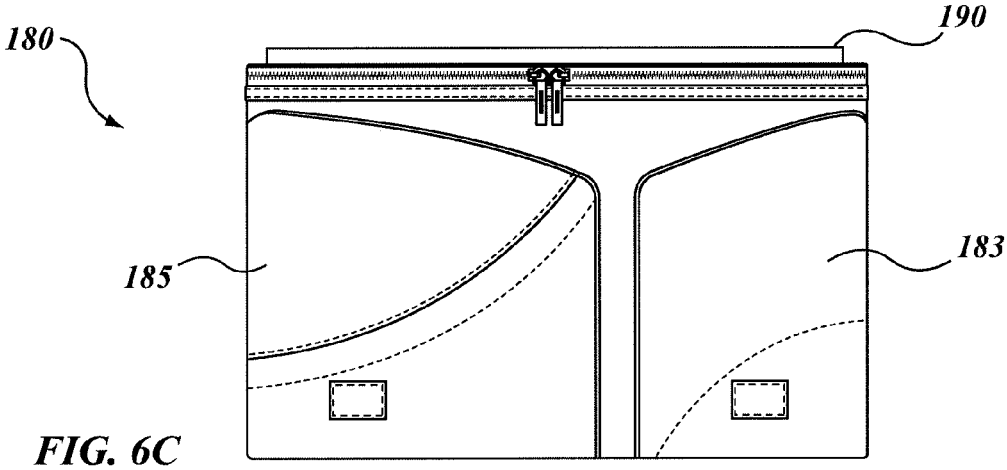
FIG. 6*c* is a front view of the container assembly of FIG. 6*b;*
Figure 6D:
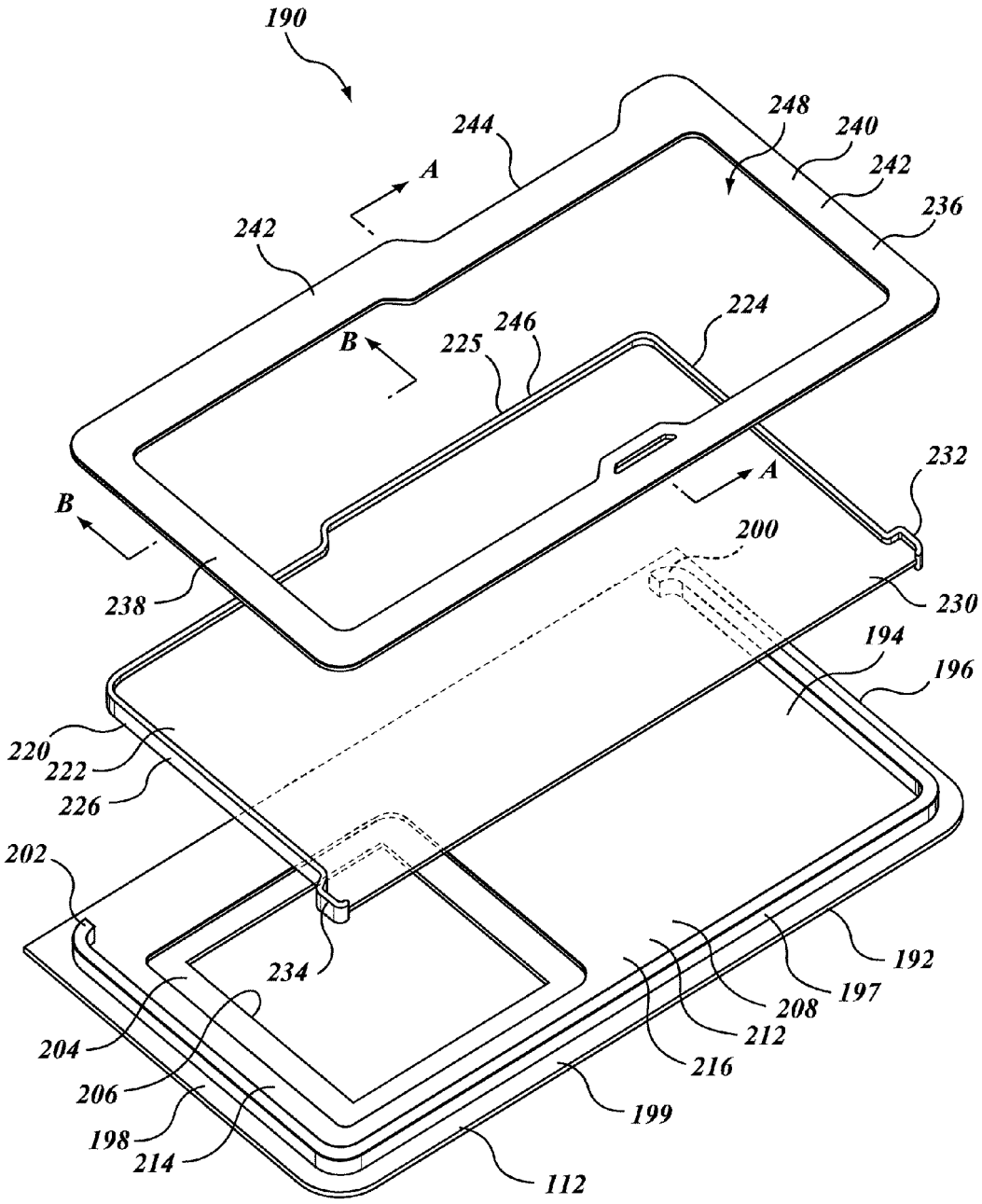
FIG. 6*d* is an exploded view of a three-part work surface sandwich assembly used in the container assembly of FIG. 6*a;*
Figure 6E:
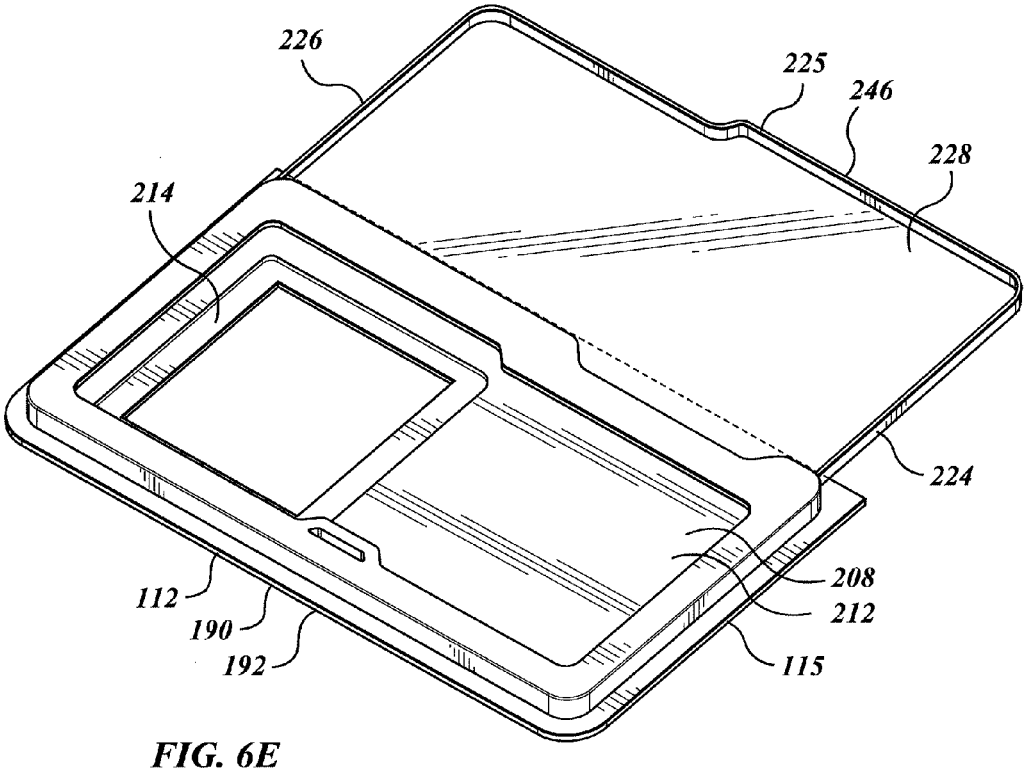
FIG. 6*e* shows the assembled members of with work surface assembly of FIG. 6*d* in an extended condition.
Figure 6F:
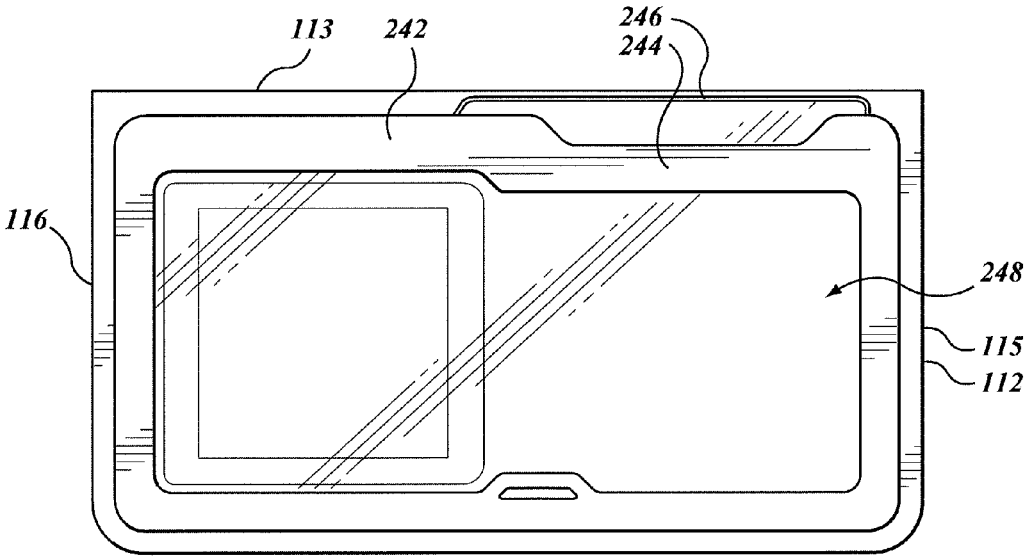
FIG. 6*f* shows a top view of the assembly of FIG. 6*e* in a closed or retracted position.

In the extended position shown in FIGS. 6*a* and 6*e*, member 220 forms a cantilever. The cantilever may extend over portion 186 to (or, indeed, past) hinge 62. Portion 186 may support member 220, to the point of hinge 62 functioning as a fulcrum, or reaction, of the cantilever. A reaction moment is provided by the engagement of the front edge flange 230 of member 220 with the rear marginal spanning edge portion 242 of member 240. Member 240 may have substantially rectangular opening 248 defined therein such as to permit access to auxiliary opening 206, and also to the upwardly facing working surface 212 of member 192 when member 240 is in the extended position. Further, opening 248 gives access to work surface 228 when member 220 is in the closed, retracted, or storage position of FIG. 2*e*. Thus in the expanded position the total area of work surface available includes both region 212 and work surface 228, and in the closed position, work surface 228. This combined table top may provide a suitably sized area for preparing foods or drinks, or for eating while on a picnic or other outing.

Figure 7A:
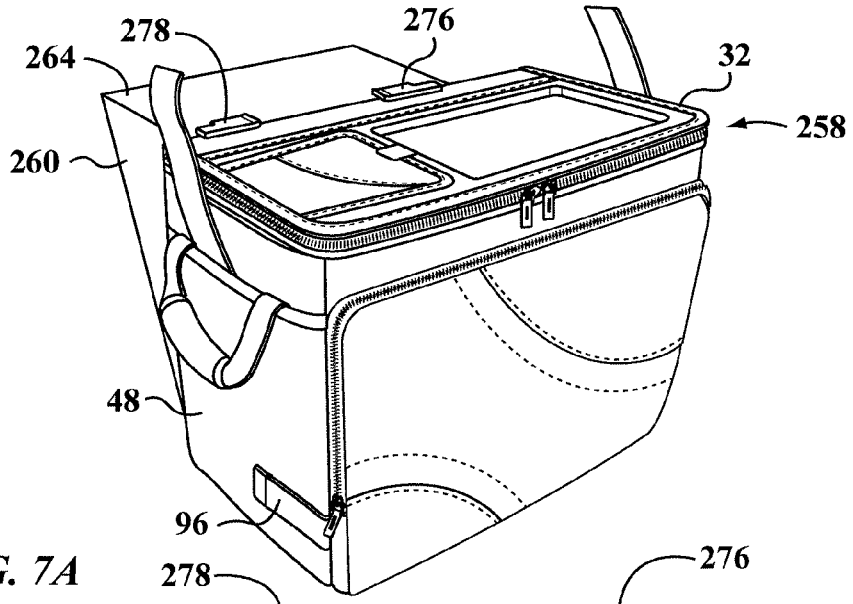
FIG. 7*a* is a perspective view from the front right hand corner of a further soft-sided insulated container assembly to that of FIG. 1*a*, having an extending shelf assembly mounted to a rear wall thereof.
Figure 7B:
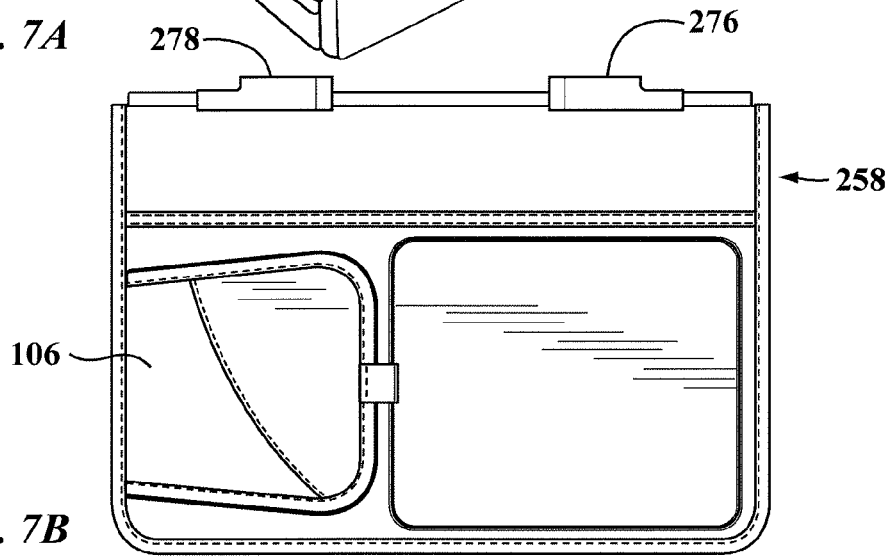
FIG. 7*b* is a top view of the container assembly of FIG. 7*a;*
Figure 7C:
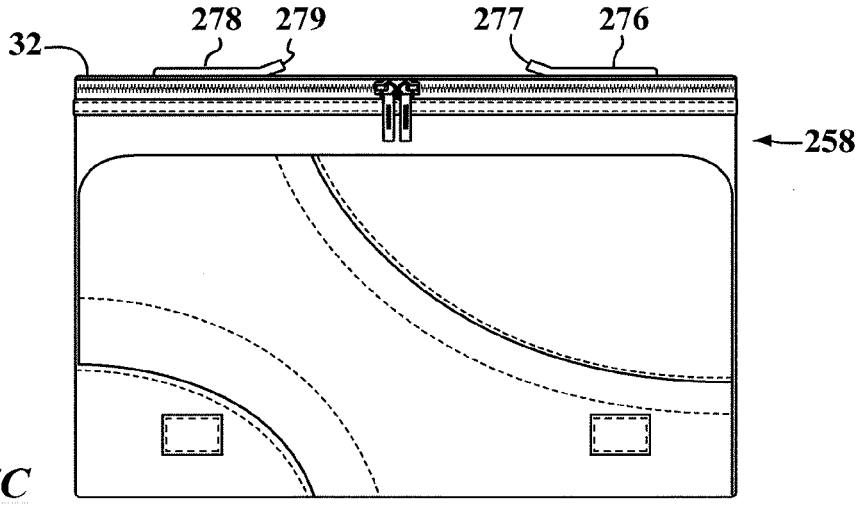
FIG. 7*c* is a front view of the container assembly of FIG. 7*a;*
Figure 7D:
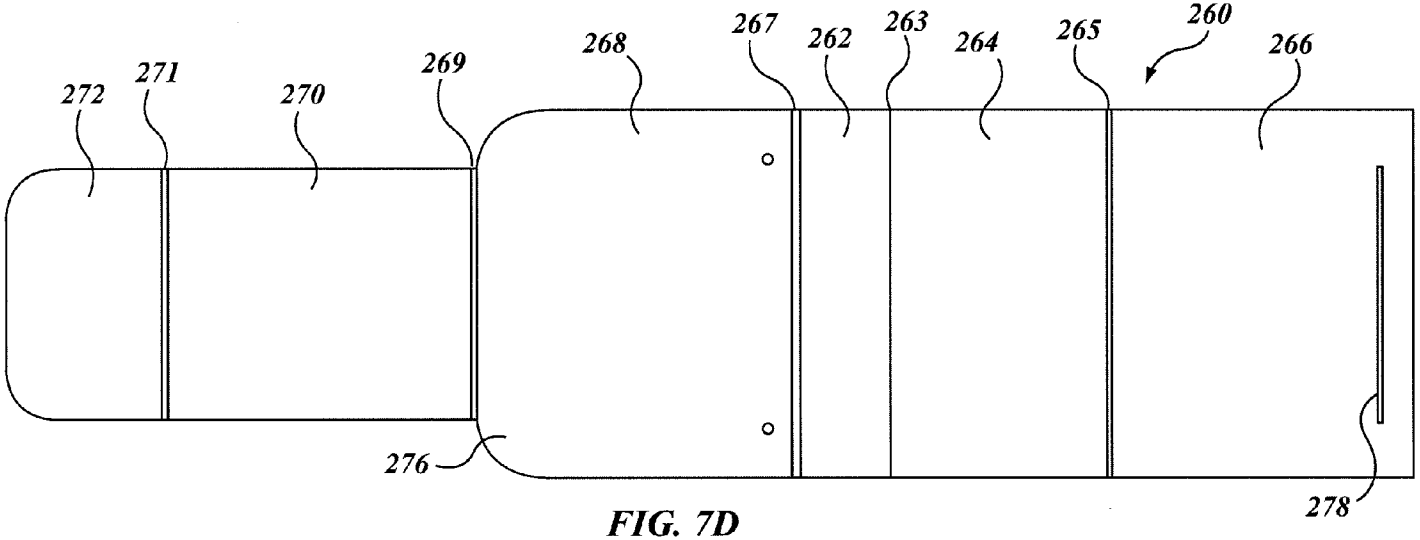
FIG. 7*d* is a developed, that is, unfolded, view of the shelf assembly of the container assembly of FIG. 7*a;*
Figure 7F:
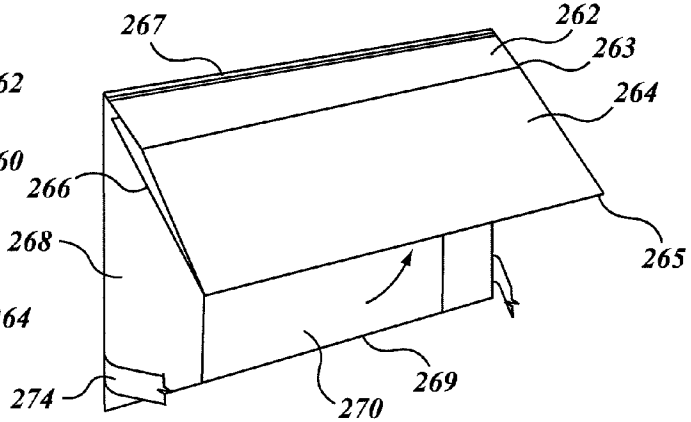
FIG. 7*f* is a perspective view of the shelf assembly of FIG. 7*e* in a partially unfolded position.
Figure 7E:
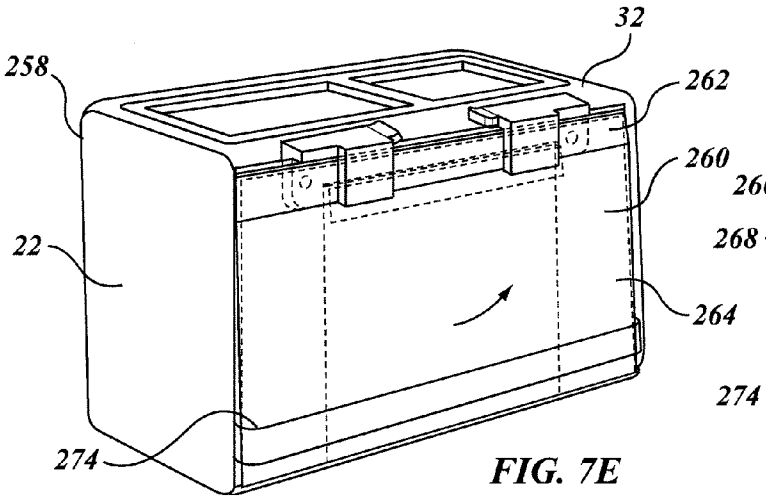
FIG. 7*e* is a perspective view of the shelf assembly of FIG. 7*d* in a collapsed or folded position.
Figure 7G:
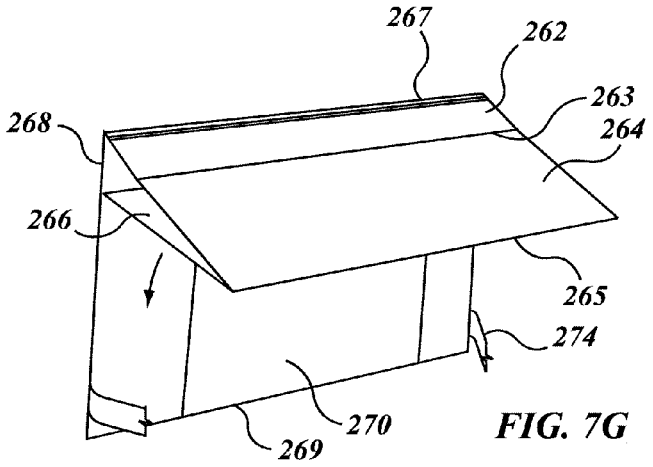
Figure 7H:
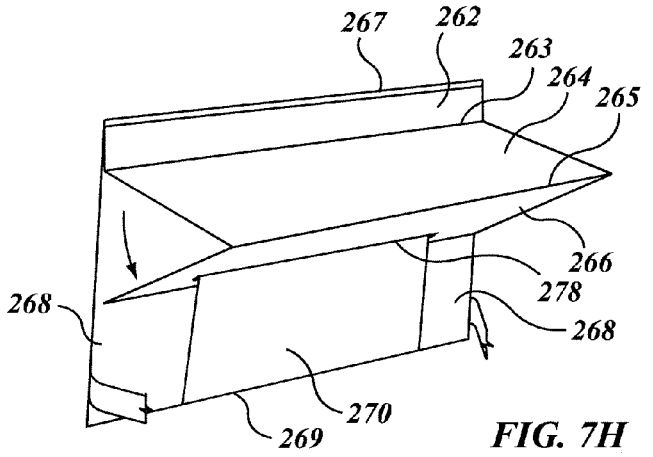
FIG. 7*h* is a perspective view of the shelf assembly of FIG. 7*e* in a partially unfolded position.
Figure 7I:
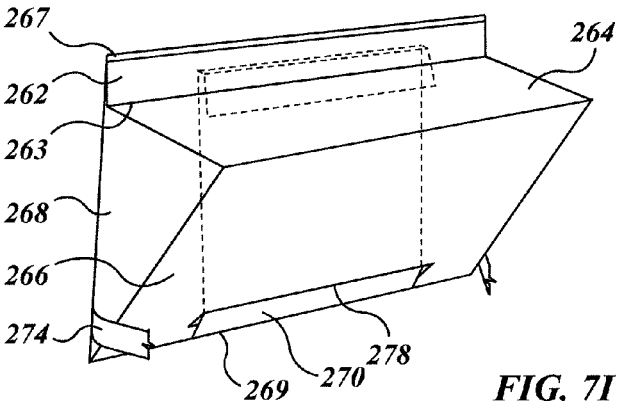
FIG. 7*i* is a perspective view of the shelf assembly of FIG. 7*e* in a partially unfolded position.
Figure 7J:
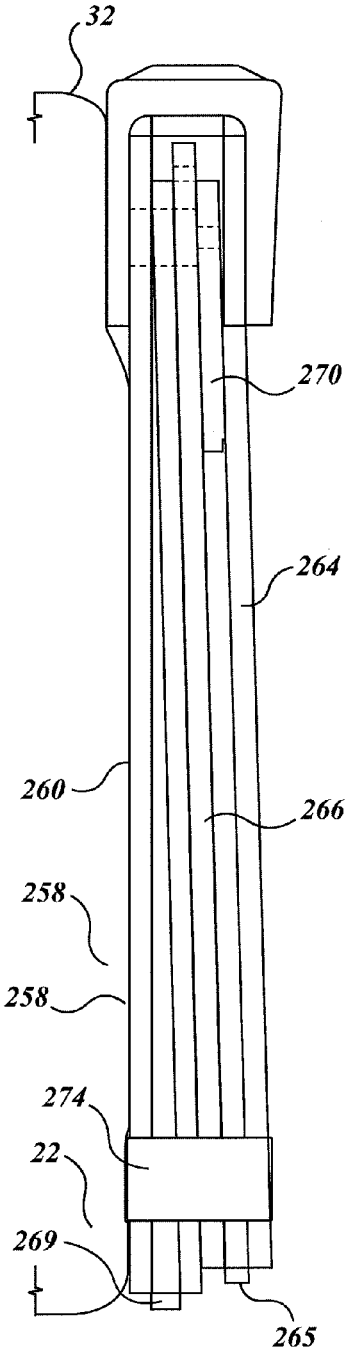
FIG. 7*j* is a side view of the shelf assembly of FIG. 7*e* in a fully folded position or condition as in FIG. 7*e;*

In a further alternative, shown in FIGS. 7*a*-7*l*, an extended, or extendable, work surface assembly 260 may be mounted to the rear wall panel of a container assembly 258, which may be substantially similar to a body such as body 22 of soft-sided insulated container assembly 20. Working surface assembly 260 may be a folding assembly made of rigid members 262, 264, 266, 268, 270 and 272. A storage position or condition retainer element is identified as 274. Item 274 may have the form of an elasticized band or strip or cord having first and second ends mounted in appropriately convenient locations such as the nether (i.e., lower) regions of the container end walls 46, 48 of body 22, perhaps at or near the junction with the insulated rear wall. Left and right hand securement fittings, are identified as clamps 276 and 278, respectively. Clamps 276 and 278 are movable from a locked position, as shown in FIGS. 7*e* and 7*j*, to an unlocked position by lifting on the slightly raised thumb tabs, or end levers, 277, 279, causing them to pivot on their pivots 275 to a raised, disengaged position, allowing motion of the various other members. When assembly 260 has been moved to its open, or deployed position, clamps 276, 278 are pivoted in the other direction and returned to their securing, or locking position. When assembly 260 is folded, the procedure is reversed.

In one embodiment, with the exception of retaining hardware such as clamps 276, 278 and retainer element 274, working surface assembly 260 may be manufactured from a single, monolithic sheet, 276, with folds, and a cut out or aperture 278, as indicated in FIG. 7*d*. The single fold between items 262 and 264 is indicated as hinge 263; the double fold between items 264 and 266 is indicated as hinge 265; the double fold between items 262 and 268 is indicated as hinge 267; the double fold between items 268 and 270 is indicated as hinge 269; and the double fold between items 270 and 272 is indicated as hinge 271.

Figure 7L:
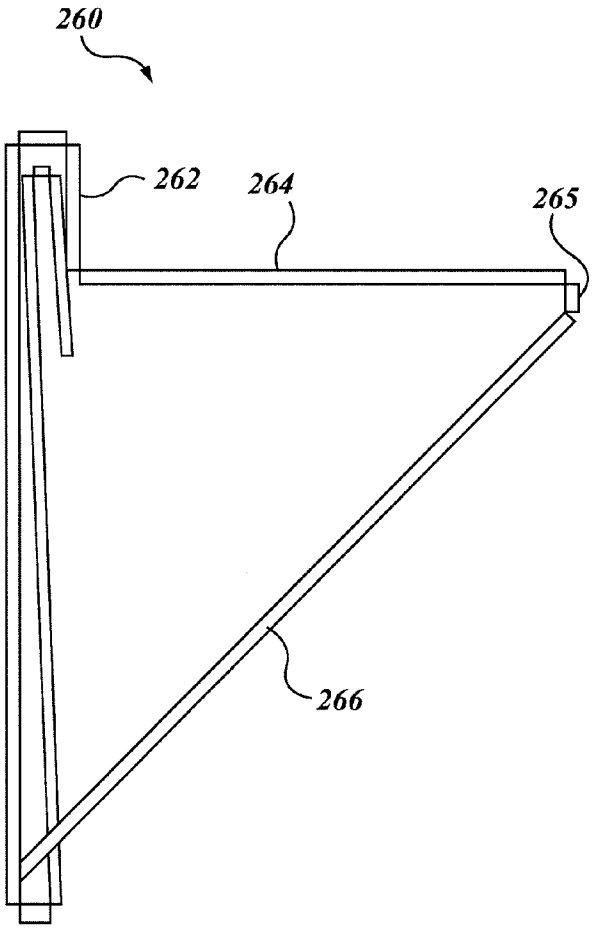
FIG. 7*l* is a side view of the shelf assembly of FIG. 7*j* in a fully expanded and deployed position or condition.
Figure 7K:
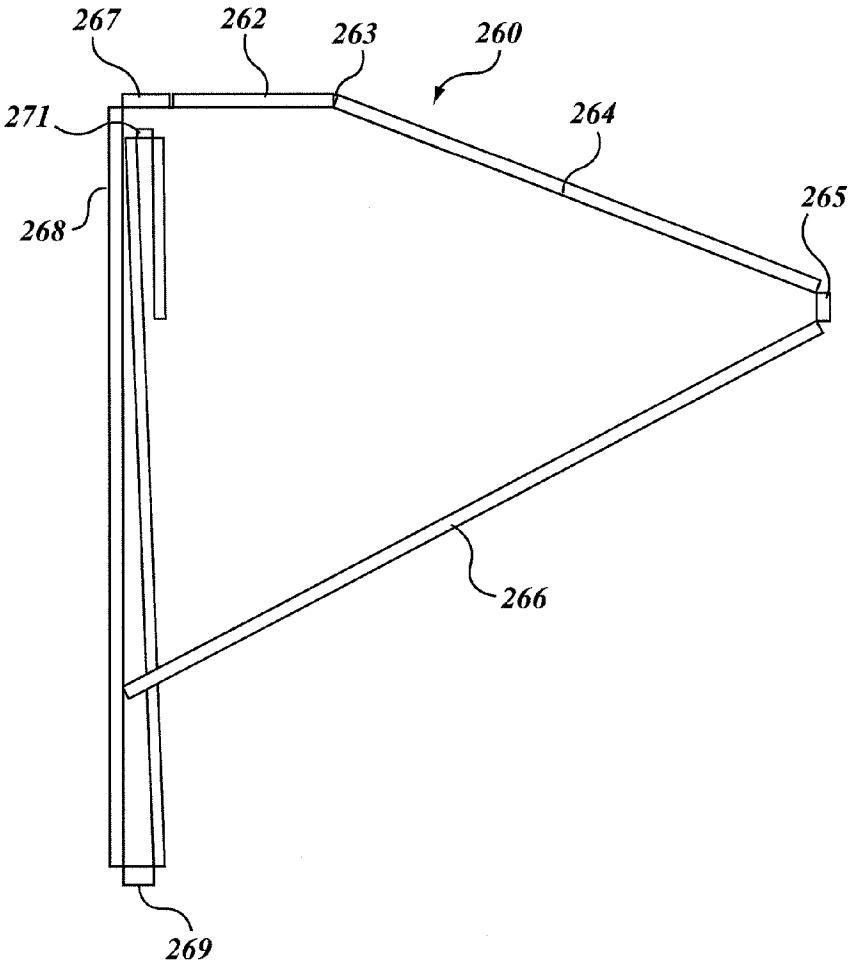
FIG. 7*k* is a side view of the shelf assembly of FIG. 7*j* in a partially unfolded position.

As can be seen in FIGS. 7*a* and 7*j*, in the collapsed, or folded condition, the tray, or table-top work surface extension, in the form of a rigid member 264, lies adjacent to its various strut members adjacent and substantially parallel to the back panel 256 of assembly 258, and is secured in that position by clamps 276, 278 and retainer 274. When a work surface is desired, the retainer and the clamps are released from the securement position shown in FIG. 7*e*, such that member 264 may be lifted upwardly and outwardly in a curving path as suggested in FIG. 7*f*, and that member 262 may pivot upwardly and outwardly on hinge 263 while this happens. As it does so, first strut member 266 is released, and falls or slides downwardly, with aperture 278 sliding down strut portion 270, which itself can swings or flex outwardly somewhat on hinge 279 until members 266 and 270 are locked against each other and can rotate no further outward, with the distal end of member 266 seating adjacent hinge 269, thus defining a strut supporting the distal edge of member 264. Rigid base panel 268 maintains the spacing between hinge 267 and hinge 269 to which member 262 is attached. In the last position, of FIG. 7*g*, panel 264 has rotated to a right angle relative to panel 262, which now sits flat parallel to members 268, 270, and 272. Inasmuch as the working surface of member 264 is exposed even when in the closed position, retaining walls or flanges can be formed in the lateral margins thereof if desired without interfering with the function of the apparatus, and a retaining wall, or lip may be mounted across the distal end of member 264 adjacent to hinge 265. In the position of FIG. 7*l* clamps 276, 278 may be rotated laterally inwardly and downwardly on their pivots pins 282, to hold member 262, and thus the proximal end of member 264 close to the wall. Pivot pins 282 may pass through apertures 284 in member 268, and protrude to act as stops for the back side of member 262. In the reverse process, when the clamps are released, member 266 can be squeezed toward member 264, and the structure will fold, with slots 286 being clearance slots for pins 282.

Figure 7M:
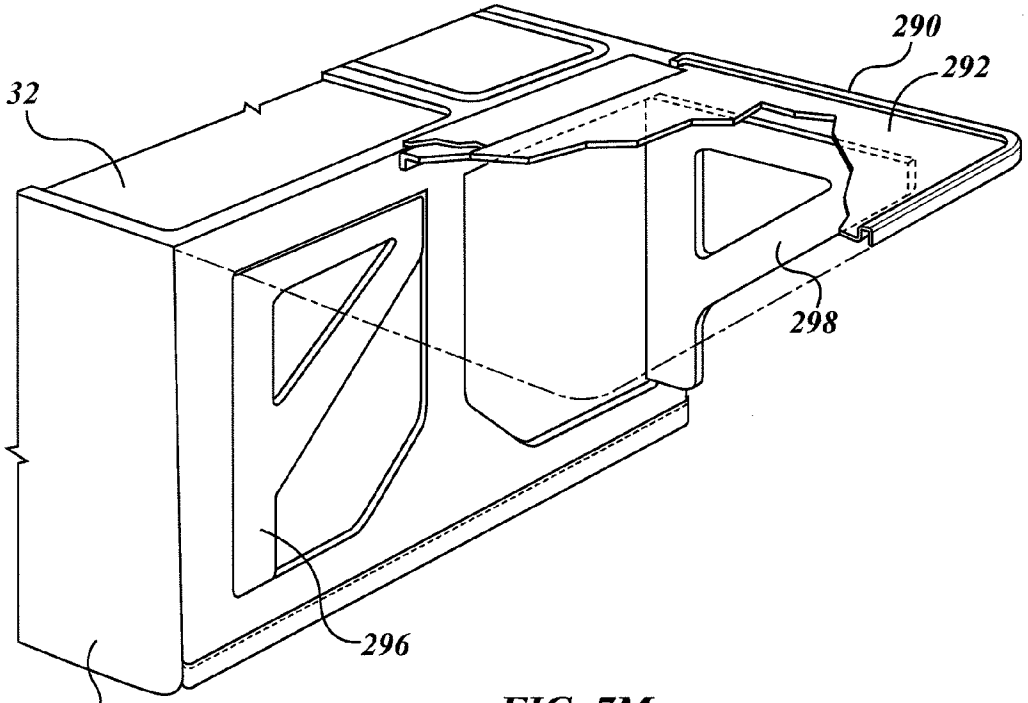
FIG. 7*m* is a scrap perspective view of an alternative shelf assembly to that of FIG. 7*j* with a drop leaf as opened.
Figure 7N:
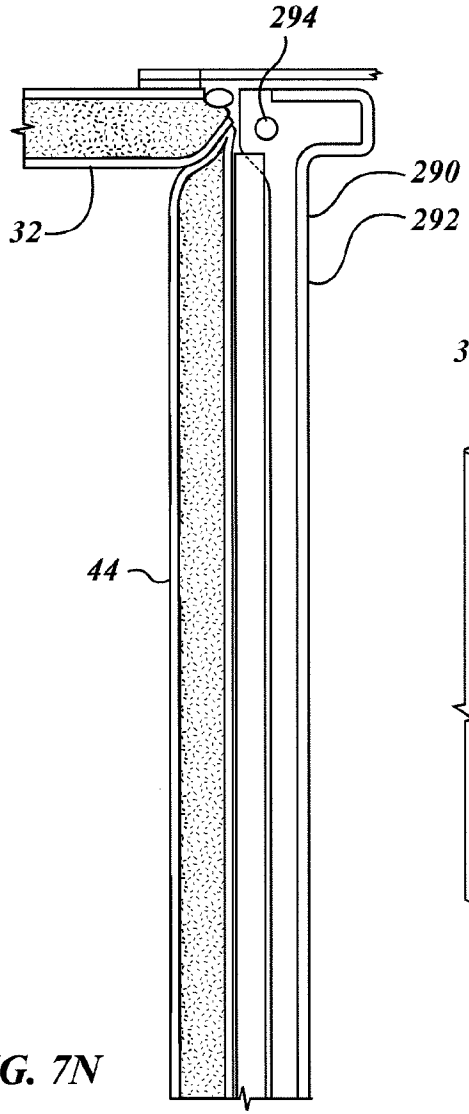
FIG. 7*n* is a cross-section of the shelf assembly of FIG. 7*m* in a closed, retracted, or storage, position.

There are other ways of constructing a collapsible or extendable shelf structure. One alternate is shown in FIGS. 7*m* and 7*n*. A collapsible, folding shelf assembly is indicated generally as 290. It includes a substantially rigid member 292 that defines a work surface, not unlike member 220 in construction, having a hinge 294 at the proximal edge, and flange margins around the three other sides to enhance stiffness. Although FIG. 7*m* is a partially cut-away view, the full extent of rigid member 292 is indicated by the intermittent dashed line. Rigid member 292 is a drop leaf. Assembly 290 also includes two movable wings, or arms, or supports, 296, 298 that swing outwardly to support member 292 in its deployed or open position, and swing inwardly to lie flat against the rear wall of the insulated structure, nesting inside the profile of member 292 when the drop-leaf is in its lowered or closed position. It may be that a soft-sided collapsible insulated container assembly may include both the substantially rigid lid assembly of container assembly 20 and an auxiliary shelf assembly, such as folding shelf assembly 260. In such circumstances, in the collapsed condition the substantially rigid lid portion may lie against the front wall of the folded assembly, and the substantially rigid folded shelf assembly may lie substantially flat against the rear wall. Other collapsible shelf arrangements are possible, whether using telescoping members or over-center arms or other means.

In the embodiments of FIGS. 7*a*-7*l* and 7*m*-7*n*, the working surface can be deployed or retracted without obstructing access to the auxiliary closure member of lid 32. By contrast, in FIGS. 6*a*-6*h*, when member 220 is in the closed position, the auxiliary closure member 210 is obstructed. Thus the embodiments of FIGS. 7*a*-7*n* provide a temporary, collapsible, working surface that may provide a substantially flat and level place on which to rest objects, without impeding access to the secondary closure member, i.e., the secondary closure member remains free of obstruction whether the working surface is deployed or not.

The embodiments illustrated and described above illustrate individual non-limiting examples in which the principles of the present invention are employed. It is possible to make other embodiments that employ the principles of the invention and that fall within the following claims. To the extent that the features of those examples are not mutually exclusive of each other, the features of the various embodiments may be mixed-and-matched, i.e., combined, in such manner as may be appropriate, without having to resort to repetitive description of those features in respect of each possible combination or permutation. The invention is not limited to the specific examples or details which are given by way of illustration herein, but only by the claims, as mandated by law. The claims are to be given the benefit of purposive interpretation to include equivalents under the doctrine of equivalents.

We claim:

1. A soft-sided insulated container having a soft-sided insulated body defining an insulated chamber therewithin, and a top;

said top having a rigid member mounted thereto, said rigid member defining a work surface upon which to rest objects;

said top defining a first closure member of said container;

said top being movable relative to said body between an open position and a closed position;

said body being movable between a collapsed position and a non-collapsed position;

said rigid member of said top has a table-top portion, said table-top portion being surrounded by a peripheral rim;

said top includes a second closure member, said second closure member being smaller than said first closure member; and said second closure member being mounted adjacent to said table-top portion, whereby said table-top portion provides a flat resting surface next to said second closure member.

2. The soft-sided insulated container assembly of claim 1 wherein said work surface rigid member includes a folding shelf.

3. The soft-sided insulated container assembly of claim 1 wherein said second closure member has a hinged edge and a free edge, and said free edge is oriented toward said table-top portion.

4. The soft-sided insulated container assembly of claim 1 wherein:

said top is connected to said body at a hinge, said top has an edge most distant from said hinge, and there is a first dimension from said hinge to said most distant edge;

when said body is in said non-collapsed position said body has a base upon which it rests, and a height measured from said base to said top;

said height being one of: (a) equal to said first dimension; and (b) greater than said first dimension.

5. The soft-sided insulated container assembly of claim 1 wherein said work surface rigid member spans said top in at least one of (a) a side-to-side direction; and (b) a front-to-back direction.

6. A soft-sided insulated container assembly comprising:

a soft-sided insulated lower portion, and an upper portion co-operable therewith;

said soft-sided insulated lower portion having a base and an insulated peripheral wall upstanding from said base, said base and said peripheral wall defining an insulated chamber having a top opening;

said upper portion being hingedly mounted to said lower portion;

said upper portion defining a first closure member of said insulated chamber, and being movable between a closed position and an open position to govern access thereto;

said lower portion being foldable to a collapsed position and unfoldable to an extended position; and said upper portion having an externally positioned rigid member, said rigid member defining a rigid external surface of said upper portion, said rigid external surface defining a table-top thereof when said lower portion is in said unfolded position; said table-top having an upstanding peripheral rim; and said upper portion having a second closure member defined therein, said second closure member being one of (a) beside said table-top; and (b) inset relative to said table-top.

7. The soft-sided insulated container of claim 6 wherein said soft-sided insulated container has securements operable releasably to secure said container in said folded position.

8. The soft-sided insulated container of claim 6 wherein said externally positioned rigid member overlies an insulated layer portion of said upper portion.

9. The soft-sided insulated container of claim 6 wherein said container has a removable cover for said table-top of said externally positioned rigid member.

10. The soft-sided insulated container of claim 6 wherein:

said peripheral wall of said lower portion has a width and a height;

said upper portion defines a top panel hingedly connected to an upper margin of said peripheral wall of said lower portion;

said insulated container has a hinge at which said upper portion is connected to said lower portion;

said top panel has a proximal portion adjacent to said hinge, and a distal portion distant from said hinge;

said distal portion includes said rigid member;

said rigid member has a width and length, said width being measured predominantly parallel to said upper margin of said rear wall, and said length being measured crosswise to said width; and said length of said rigid member is one of (a) less than, and (b) equal to, said height of said front wall of said body.

11. The soft-sided insulated container of claim 6 wherein said table-top defines a work surface; said second closure member pivots on a hinged connection; and said second closure member is oriented to open toward a largest portion of said work surface.

12. The soft-sided insulated container of claim 6 wherein said rigid member defines a work surface, and said work surface includes a portion bounded by a peripheral retaining wall whereby to discourage the sliding of objects thereoff when said table-top is in use.

13. The soft-sided insulated container of claim 6 wherein said upper portion defines a top panel of said container; said top panel has a breadth and a width; and said rigid member has at least one of (a) a breadth less than said breadth of said top panel; and (b) a width that is less than said width of said top.

14. The soft-sided insulated container of claim 13 wherein said rigid member spans said top panel in one direction.

15. The soft-sided insulated container of claim 6 wherein said upper portion defines a top panel; said top panel has a front edge and an opposed rear edge at which said top panel is joined to said body, a left hand edge and an opposed right hand edge; and said rigid member spans said top panel crosswise between said left hand and right hand edges.

16. The soft-sided insulated container of claim 15 wherein said rear edge of said top panel is hingedly connected to said lower portion of said container, and said externally positioned rigid member has rear a margin spaced forwardly from said rear edge of said top panel.

17. The soft-sided insulated container of claim 6 wherein:

said top panel is connected to said lower portion of said container at a hinge, said top panel has an edge most distant from said hinge, and a first dimension from said hinge to said most distant edge;

when in said extended position said lower portion has a height; and said first dimension is one of (a) equal to said height; and (b) less than said height.

18. The soft-sided insulated container of claim 17 wherein:

said upper portion defines a top panel;

said top panel has a front edge and an opposed rear edge at which said top panel is joined to said body, a left hand edge and an opposed right hand edge;

said rear edge of said top panel is hingedly connected to said body of said container, and said externally positioned rigid member has a rear margin spaced forwardly from said rear edge of said top panel;

said top panel has a rearward portion defined between said rear edge of said top panel and said rear margin of said rigid member, and a forward portion defined more distantly from rear edge of said top panel, said forward portion including said rigid member;

when said body is in said folded position said front wall is closer to said rear wall than in said un-folded position;

in said folded position said rearward portion over-reaches said front wall, and said rigid member of said forward portion depends forwardly of said front wall.

19. The soft-sided insulated container of claim 18 wherein said rearward portion bends, and, in said folded position of said body, said rearward portion extends over said folded body.

20. The soft-sided insulated container of claim 19 wherein, in said folded position of said lower portion, said lower portion has an overall through thickness, said proximal portion of top panel has a reach corresponding to said through thickness, and, when said body is in said folded position said distal portion of said top panel depends forwardly of said front wall.

21. The soft-sided insulated container of claim 6 wherein said upper portion includes a second externally positioned rigid member, said second externally positioned rigid member being movable relative to said first externally positioned rigid member to form an enhanced table-top working surface.

22. The soft-sided insulated container of claim 21 wherein said first and second externally positioned rigid members are mutually slidably engaged.

* * * * *